US009956768B2

(12) United States Patent
Kyoso

(10) Patent No.: US 9,956,768 B2
(45) Date of Patent: May 1, 2018

(54) LIQUID EJECTION DEVICE AND SHORT-CIRCUIT DETECTION METHOD

(71) Applicant: FUJIFILM Corporation, Tokyo (JP)

(72) Inventor: Tadashi Kyoso, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days. days.

(21) Appl. No.: 15/490,908

(22) Filed: Apr. 19, 2017

(65) Prior Publication Data

US 2017/0297327 A1 Oct. 19, 2017

(30) Foreign Application Priority Data

Apr. 19, 2016 (JP) ..... 2016-083676

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ... B41J 2/04541; B41J 2/04581; B41J 29/393
See application file for complete search history.

(56) References Cited

U.S. PATENT DOCUMENTS 6,502,914 B2 * 1/2003 Hosono ..... B41J 2/04581 347/11
6,938,989 B2 * 9/2005 Silverbrook ..... B41J 2/04528 347/20
2006/0268035 A1 * 11/2006 Lee ..... B41J 2/2139 347/12
2006/0290728 A1 * 12/2006 Kamiya ..... B41J 29/393 347/14
2010/0207974 A1 8/2010 Menzel et al.
2012/0293577 A1 11/2012 Kyoso et al.

FOREIGN PATENT DOCUMENTS

JP 2008-230222 10/2008
JP 2010-241118 10/2010
JP 2012-240305 12/2012

* cited by examiner

*Primary Examiner* — Lamson Nguyen
(74) *Attorney, Agent, or Firm* — JCIPRNET

(57) ABSTRACT

A liquid ejection device includes a head driving unit that generates a first driving voltage and a second driving voltage in which whether or not there is ejection of liquid from a first ejection element in a case where the first driving voltage alone is applied to the first ejection element that is a detection target of a short circuit between ejection elements is different from whether or not there is ejection of liquid from the first ejection element in a case where the first driving voltage and the second driving voltage are applied to the first ejection element, supplies the first driving voltage to the first ejection element, and supplies the second driving voltage to the second ejection element suspected of a short circuit with the first ejection element.

11 Claims, 17 Drawing Sheets

LIQUID EJECTION DEVICE AND SHORT-CIRCUIT DETECTION METHOD

CROSS-REFERENCE TO RELATED APPLICATIONS

The present application claims priority under 35 U.S.C. § 119 to Japanese Patent Application No. 2016-083676, filed on Apr. 19, 2016. The above application is hereby expressly incorporated by reference, in its entirety, into the present application.

BACKGROUND OF THE INVENTION

1. Field of the Invention

The present invention relates to a liquid ejection device and a short-circuit detection method and, more particularly, to a short-circuit detection technology in a liquid ejection head.

2. Description of the Related Art

JP2010-241118A describes a liquid ejection device on which a liquid ejection head including a plurality of ejection elements is mounted. The liquid ejection device described in JP2010-241118A detects a short circuit between the ejection elements included in the liquid ejection head.

Electrical measurement such as capacitance measurement or leakage current measurement, or observation of wirings such as observation of wirings using an optical microscope or observation of an infrared image during application of electrical stimulation is applied to the detection of the short circuit between the ejection elements.

A term ejection element herein corresponds to the term liquid ejection unit in JP2010-241118A. A term liquid ejection head herein corresponds to the term print head disclosed in JP2010-241118A. A term liquid ejection device herein corresponds to the term liquid ejection device in JP2010-241118A.

JP2008-230222A describes a liquid ejection head including a detection electrode portion that is electrically connected to a driving electrode portion of an ejection element. In the liquid ejection head described in JP2008-230222A, in a detection mode, a detection driving voltage is applied to the driving electrode portion. If a detection voltage appears at the detection electrode portion, a detection signal is input from the detection electrode portion to a voltage detection circuit.

An electrical connection state of various components of the liquid ejection head is detected from the voltage appearing at the detection electrode portion using the voltage detection circuit. The term ejection element herein corresponds to a term piezoelectric unit in JP2008-230222A.

Further, a term liquid ejection head here corresponds to a term inkjet head disclosed in JP2008-230222A. A term detection used herein corresponds to a term inspection in JP2008-230222A.

JP2012-240305A describes a liquid ejection device that prevents ejection at all times even in a case where control fault such as fault of a circuit control element occurs, using a combination of a main waveform unit for ejection driving and a sub-waveform unit that suppresses the ejection in combination with the main waveform unit.

SUMMARY OF THE INVENTION

In a case where a short circuit occurs between electrical wirings electrically connected to ejection elements after the liquid ejection head is mounted on the liquid ejection device, it is possible to determine whether or not exchange of the liquid ejection head is required if it can be determined whether a short circuit occurs in the electrical wiring electrically connected to any of the ejection elements.

Further, the ejection element is not used. Accordingly, it is possible to realize continuous use without exchange of the liquid ejection head.

JP2010-241118A and JP2008-230222A do not describe or suggest detection of whether or not there is a short circuit of the ejection elements according to whether or not there is the ejection of the liquid ejection head. Further, in a configuration described in JP2012-240305A, it is difficult to detect a short circuit between the ejection elements.

The present invention has been made in view of the above circumstances, and an object thereof is to provide a liquid ejection device and a short-circuit detection method capable of detecting a short circuit between ejection elements depending on whether or not there is ejection of a liquid ejection head.

To achieve the above object, the following aspects of the invention are provided.

A liquid ejection device according to a first aspect is a liquid ejection device, comprising: a liquid ejection head including a plurality of ejection elements; a driving voltage generation unit that generates a first driving voltage that is used at the time of detection of a short circuit of the plurality of ejection elements and a second driving voltage that is used at the time of detection of a short circuit of the plurality of ejection elements; and a driving voltage supply unit that supplies the first driving voltage to the first ejection element that is a detection target of a short circuit between ejection elements, and supplies the second driving voltage to the second ejection element that is suspected of the short circuit with the first ejection element, in which the driving voltage generation unit generates the first driving voltage and the second driving voltage in which whether or not there is ejection of liquid from the first ejection element in a case where the first driving voltage alone is applied to the first ejection element is different from whether or not there is ejection of liquid from the first ejection element in a case where the first driving voltage and the second driving voltage are applied to the first ejection element.

According to the first aspect, a case where the first ejection element that is the short-circuit detection target and the second ejection element suspected of a short circuit with the first ejection element are short-circuited, and a case where the first ejection element and the second ejection element are not short-circuited are different in whether or not there is ejection from at least the first ejection element. Accordingly, it is possible to detect a short circuit between the first ejection element and the second ejection element according to whether or not there is ejection from the first ejection element.

The ejection element is a minimum unit that ejects liquid. A configuration example of the ejection element may include a configuration in which a nozzle unit that ejects liquid and a pressurizing element that pressurizes the liquid in the nozzle unit.

Further, a configuration example of the nozzle unit may include a configuration in which a nozzle opening, a pressure chamber, and a supply port that communicates with the pressure chamber are included.

A short circuit between the ejection elements may include a short circuit of at least one of an electrical wiring, an electrode, and an output terminal for a driving voltage electrically connected to each ejection element.

An example of the second ejection element suspected of a short circuit with the first ejection element may include an ejection element that is arranged at a position adjacent to the first ejection element. The position adjacent to the first ejection element may be an adjacent position in a first direction or may be an adjacent position in a second direction orthogonal to the first direction. The position adjacent to the first ejection element may be an adjacent position in a third direction obliquely intersecting the first direction or the second direction.

The supply of the driving voltage indicates an operation of the driving voltage supply unit. The application of the driving voltage indicates a result of the supply of the driving voltage viewed from the ejection element. In a case where electrical abnormality such as a short circuit or an opened circuit occurs in an electrical wiring electrically connected to each ejection element, a driving voltage that is not supplied from the driving voltage supply unit may be applied or a driving voltage to be supplied from the driving voltage supply unit may not be applied.

The supply of the first driving voltage to the first ejection element may be performed and then the supply of the second driving voltage to the second ejection element may be performed. The supply of the second driving voltage to the second ejection element may be performed and then the supply of the first driving voltage to the first ejection element may be performed.

A driving waveform acquisition unit that acquires a first driving waveform of a first driving voltage and a second driving waveform of a second driving voltage is included, and the driving voltage generation unit can generate a first driving voltage based on the acquired first driving waveform and a second driving voltage based on the second driving waveform.

A waveform storage unit in which the first driving waveform and the second driving waveform are stored may be included, and the driving waveform acquisition unit may read the first driving waveform and the second driving waveform from the waveform storage unit to acquire the first driving waveform and the second driving waveform.

In a second aspect, in the liquid ejection device according to the first aspect, a first electrical wiring electrically connected to the first ejection element and a second electrical wiring electrically connected to the second ejection element may be arranged at adjacent positions.

According to the second aspect, in a case where it is easy for a short circuit between the first electrical wiring electrically connected to the first ejection element and the second electrical wiring electrically connected to the second ejection element to occur, it is possible to detect the short circuit between the first ejection element and the second ejection element.

The first electrical wiring and the second electrical wiring may be electrical wirings inside the liquid ejection head or may be at least one of an electrical wiring formed in a wiring member electrically connected to the liquid ejection head and an electrical wiring formed in an electrical circuit board electrically connected to the wiring member.

In a third aspect, in the liquid ejection device according to the first aspect or the second aspect, a first driving voltage output terminal from which a first driving voltage to be supplied to the first ejection element is output and a second driving voltage output terminal from which a second driving voltage to be supplied to the second ejection element is output may be arranged at adjacent positions.

According to the third aspect of the present invention, in a case where it is easy for a short circuit between the first driving voltage output terminal from which the first driving voltage to be supplied to the first ejection element is output and the second driving voltage output terminal from which the second driving voltage to be supplied to the second ejection element is output to occur, it is possible to detect a short circuit between the first ejection element and the second ejection element.

According to a fourth aspect, in the liquid ejection device according to any one of the first to third aspects, the driving voltage supply unit may regard all ejection elements that are likely to be short-circuited to the first ejection element as the second ejection elements, and supply the second driving voltage.

According to the fourth aspect, it is possible to detect a short circuit with the first ejection element for all ejection elements that are likely to be short-circuited to the first ejection element.

In a case where there are a plurality of second ejection elements, the short-circuit detection with the first ejection element may be executed sequentially for each of the plurality of second ejection elements. In a case where there are a plurality of second ejection elements, the short-circuit detection with the first ejection element may be executed collectively for some or all of the plurality of second ejection elements.

According to a fifth aspect, the liquid ejection device according to any one of the first to fourth aspects may further comprise an imaging data acquisition unit that acquires imaging data obtained using an imaging device that images a liquid passage area through which liquid ejected from the plurality of ejection elements passes in a period in which the first driving voltage is supplied from the driving voltage supply unit to the first ejection element, and the second driving voltage is supplied from the driving voltage supply unit to the second ejection element.

According to the fifth aspect, it is possible to determine whether or not there is ejection from the first ejection element on the basis of the imaging data obtained using the imaging device.

In a sixth aspect, the liquid ejection device according to any one of the first to fourth aspects may further comprise an observation result information acquisition unit that acquires an observation result of observation of whether or not there is a dot in a medium after a period in which the first driving voltage is supplied from the driving voltage supply unit to the first ejection element and after a period in which the second driving voltage is supplied from the driving voltage supply unit to the second ejection element.

According to the sixth aspect, it is possible to determine whether or not there is ejection from the first ejection element on the basis of observation data indicating the medium observation result.

In a seventh aspect, in the liquid ejection device according to any one of the first to sixth aspects, the driving voltage generation unit may generate the first driving voltage that does not cause the liquid to be ejected from the first ejection element in a case where the first driving voltage alone is applied to the first ejection element, and the second driving voltage that does not cause the liquid to be ejected from the second ejection element in a case where the second driving voltage alone is applied to the second ejection element, and the first driving voltage and the second driving voltage may be driving voltages that cause the liquid to be ejected from the first ejection element and the second ejection element in a case where the first driving voltage and the second driving voltage are applied to the first ejection element and the second ejection element.

According to the seventh aspect, if liquid is ejected from the first ejection element and the second ejection element in a case where supply of the first driving voltage to the first ejection element and supply of the second driving voltage to the second ejection element are performed, it is possible to determine that a short circuit between the first ejection element and the second ejection element occurs.

In the seventh aspect, the supply of the first driving voltage to the first ejection element may be performed and then the supply of the second driving voltage to the second ejection element may be performed. The supply of the second driving voltage to the second ejection element may be performed and then the supply of the first driving voltage to the first ejection element may be performed.

According to an eighth aspect, in the liquid ejection device of the seventh aspect, the driving voltage supply unit may supply the first driving voltage to the first ejection element, and then, supply, to the second ejection element, the second driving voltage in which a period from the start of the first driving voltage to the start of the second driving voltage is within a predetermined range including a resonance cycle of the ejection element.

According to the eighth aspect, the period from the start of the first driving voltage to the start of the second driving voltage is within a predetermined range including a resonance cycle of the ejection element. Accordingly, in a case where the first ejection element and the second ejection element are short-circuited, it is easy for liquid to be ejected from the first ejection element and the second ejection element when the first driving voltage and the second driving voltage are applied to the first ejection element and the second ejection element.

In the predetennined range including the resonance cycle, an upper limit value and a lower limit value can be calculated by multiplying the resonance cycle by a constant. The constant may be determined from a condition under which liquid can be ejected from the first ejection element.

According to a ninth aspect, in the liquid ejection device according to any one of the first to sixth aspects, the driving voltage generation unit may generate a first driving voltage that does not cause liquid to be ejected from the first ejection element in a case where the first driving voltage alone is applied to the first ejection element, and a second driving voltage that does not cause liquid to be ejected from the second ejection element in a case where the second driving voltage alone is applied to the second ejection element, and the first driving voltage and the second driving voltage may be driving voltages that cause the liquid to be ejected from the first ejection element in a case where the first driving voltage and the second driving voltage are applied to the first ejection element, and are driving voltages that do not cause the liquid to be ejected from the second ejection element in a case where the first driving voltage and the second driving voltage are applied to the second ejection element.

According to the ninth aspect, if liquid is ejected from the first ejection element in a case where supply of the first driving voltage to the first ejection element and supply of the second driving voltage to the second ejection element are performed, it is possible to determine that a short circuit between the first ejection element and the second ejection element occurs.

In a tenth aspect, in the liquid ejection device according to the ninth aspect, the driving voltage supply unit may supply the second driving voltage to the second ejection element, and then, supply, to the first ejection element, the first driving voltage in which a period from the start of the second driving voltage to the start of the first driving voltage is within a predetermined range including a resonance cycle of the ejection element.

According to the tenth aspect, since the period from the start of the second driving voltage to the start of the first driving voltage is within a predetermined range including ½ of the resonance cycle of the ejection element, it is difficult for liquid to be ejected from the first ejection element if the first driving voltage and the second driving voltage are applied to the first ejection element in a case where the first ejection element and the second ejection element are short-circuited.

A short-circuit detection method of an eleventh aspect is a short-circuit detection method of detecting a short circuit between ejection elements in a liquid ejection head including a plurality of ejection elements, the method comprising: a driving voltage generation step of generating a first driving voltage that is used at the time of detection of a short circuit of the plurality of ejection elements and a second driving voltage that is used at the time of detection of a short circuit of the plurality of ejection elements; a driving voltage supply step of supplying the first driving voltage to the first ejection element that is a detection target of a short circuit between ejection elements, and supplies the second driving voltage to the second ejection element that is suspected of the short circuit with the first ejection element; and a detection step of detecting whether or not there is a short circuit between the first ejection element and the second ejection element on the basis of whether or not there is ejection of the first ejection element, in which the driving voltage generation step includes generating the first driving voltage and the second driving voltage in which whether or not there is ejection of liquid from the first ejection element in a case where the first driving voltage alone is applied to the first ejection element is different from whether or not there is ejection of liquid from the first ejection element in a case where the first driving voltage and the second driving voltage are applied to the first ejection element.

According to the eleventh aspect, it is possible to obtain the same effects as in the first aspect.

In the eleventh aspect, it is possible to appropriately combine the same matters as those specified in the second to tenth aspects. In this case, a component responsible for a process or a function specified in the liquid ejection device can be recognized as a component of the short-circuit detection method responsible for a process or a function corresponding thereto.

According to the present invention, the case where the first ejection element that is the short-circuit detection target and the second ejection element suspected of a short circuit with the first ejection element are short-circuited, and the case where the first ejection element and the second ejection element are not short-circuited are different in whether or not there is ejection from at least the first ejection element. Accordingly, it is possible to detect a short circuit between the first ejection element and the second ejection element according to whether or not there is ejection from the first ejection element.

DESCRIPTION OF THE PREFERRED EMBODIMENTS

Hereinafter, preferred embodiments of the present invention will be described in detail with reference to the accompanying drawings. In the present specification, configurations that have been already described are denoted with the same reference signs, and description thereof is appropriately omitted.

[Description of Liquid Ejection Device]

<Overall Configuration>

Figure 1:
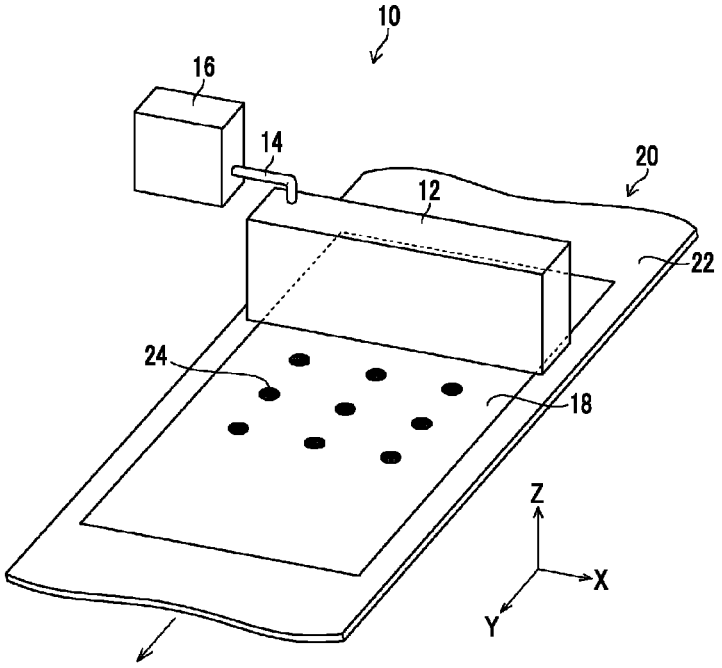
FIG. 1 is an overall configuration diagram of a liquid ejection device.

FIG. 1 is an overall configuration diagram of a liquid ejection device. The inkjet recording device 10 illustrated in FIG. 1 includes an inkjet head 12 including a plurality of ejection elements. Ink is supplied from an ink tank 16 to the inkjet head 12 through a tube 14. The ejection element is not illustrated in FIG. 1.

Figure 4:
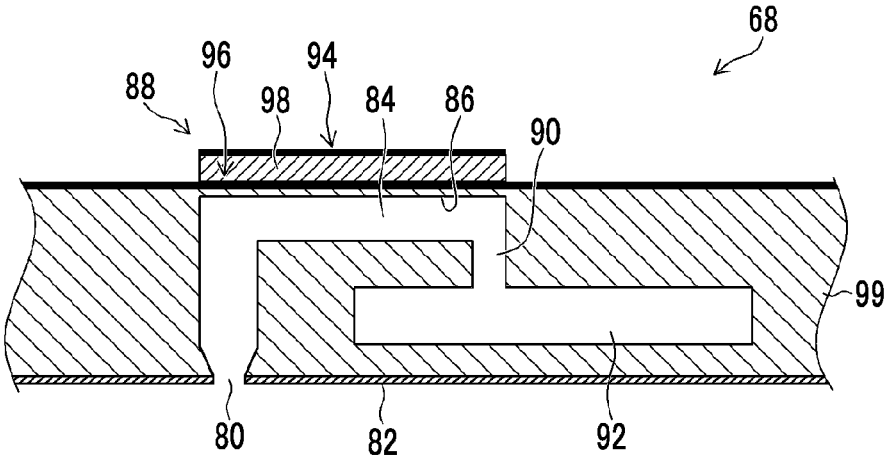
FIG. 4 is a cross-sectional view illustrating a configuration example of an ejection element.

The ejection element is denoted with a reference sign 68 and illustrated in FIG. 4. Hereinafter, the ejection element indicates the ejection element 68 illustrated in FIG. 4. The inkjet head 12 is an aspect of a liquid ejection head. The ink is an aspect of the liquid.

The inkjet recording device 10 illustrated in FIG. 1 includes a sheet conveyance unit 20 that conveys a sheet 18. The sheet conveyance unit 20 illustrated in FIG. 1 includes a conveyance belt 22 that supports a back surface of the sheet 18.

The conveyance belt 22 has an endless shape and is wound around two rollers. In the conveyance belt 22, a plurality of suction holes are provided in a sheet support area that supports the sheet 18. The two rollers around which the conveyance belt 22 is wound, and a plurality of suction holes are not illustrated.

In FIG. 1, a sheet width direction is indicated by a reference sign X. Further, a sheet conveyance direction is indicated by a reference sign Y. Further, an upward direction is indicated by a reference sign Z. The sheet width direction is a direction orthogonal to the sheet conveyance direction.

The sheet conveyance direction is a direction in which the sheet 18 is conveyed using the sheet conveyance unit 20. The upward direction is a direction opposite to a gravity direction. In a case where the sheet width direction and the sheet conveyance direction are directions parallel to a horizontal direction, the upward direction is orthogonal to both of the sheet width direction and the sheet conveyance direction.

The term orthogonal or perpendicular herein includes substantially orthogonal or vertical that achieves the same operation and effects as in the case of intersection at 90° in the case of intersection at an angle exceeding 90° or the case of intersection at an angle smaller than 90°.

Further, the term parallel herein includes substantially parallel, in which two directions are not parallel, but the same operation and effects as parallel are achieved. Further, the term the same herein includes substantial the same, in which there is a difference and the same operation and effects as the same can be obtained.

The inkjet head 12 illustrated in FIG. 1 is a line-type liquid ejection head in which a plurality of ejection elements are arranged over a length equal to or larger than a total length of the sheet 18 in the sheet width direction.

Both ends in the sheet width direction of the inkjet head 12 are supported using a head support member. The head support member is not illustrated. The head support member may also serve as a head lifting and lowering mechanism that moves the inkjet head 12 in a vertical direction.

Dots 24 using ink ejected from the inkjet head 12 are formed in the sheet 18 illustrated in FIG. 1.

In this embodiment, as an example of the relative conveyance unit that relatively conveys the inkjet head 12 and the sheet 18, an aspect in which the sheet conveyance unit 20 that conveys the sheet 18 relatively to the fixedly arranged inkjet head 12 is applied is illustrated. An arrow line not denoted with a reference sign in FIG. 1 indicates a traveling direction of the conveyance belt 22 that is a conveyance direction of the sheet 18.

For the relative conveyance unit that relatively conveys the inkjet head 12 and the sheet 18, a head movement unit (not illustrated) that moves the inkjet head 12 relatively to the fixedly arranged sheet 18 may be applied. Further, the inkjet head 12 may be moved using the head movement unit (not illustrated), and the sheet 18 may be conveyed using the sheet conveyance unit 20.

<Control System>

Figure 2:
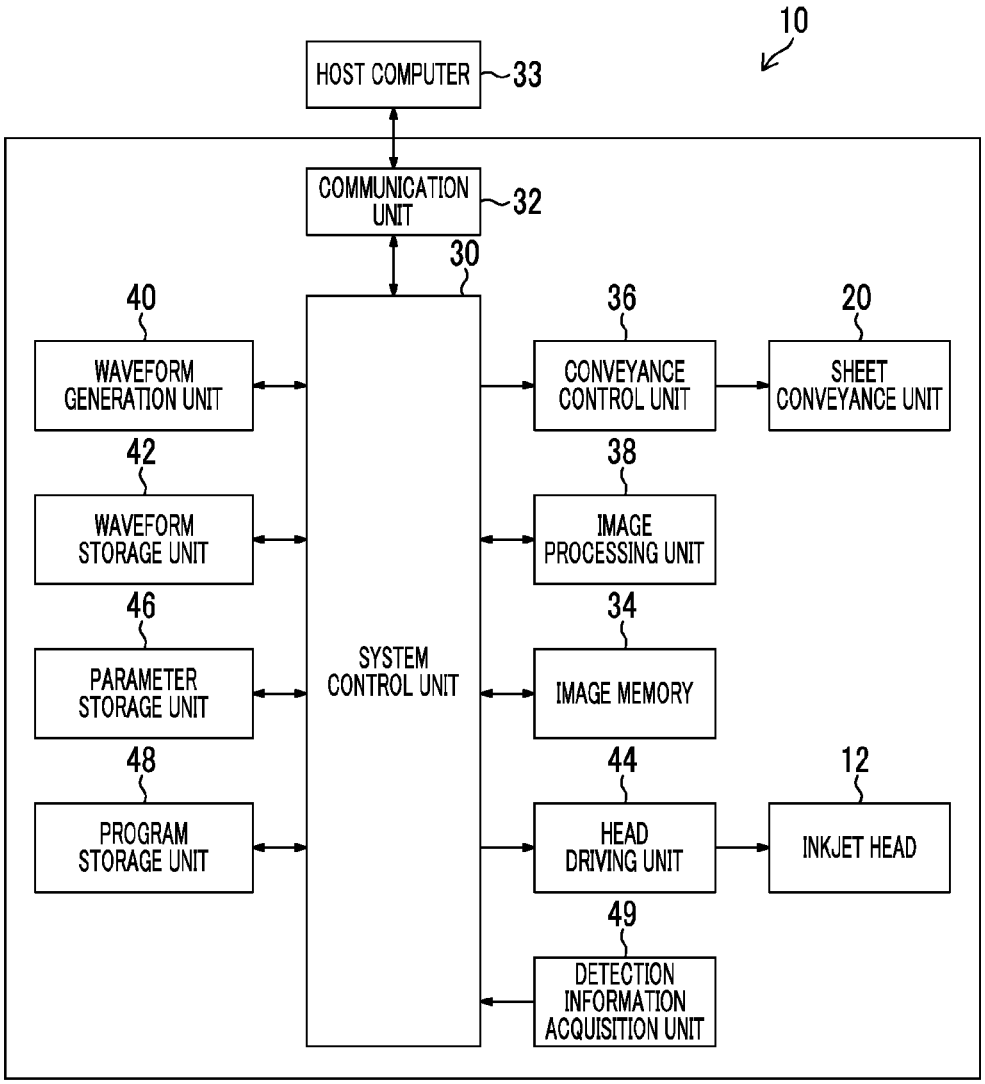
FIG. 2 is a block diagram illustrating a schematic configuration of a control system.

FIG. 2 is a block diagram illustrating a schematic configuration of a control system. The inkjet recording device 10 illustrated in FIG. 2 includes a system control unit 30.

For the system control unit 30, a configuration in which a CPU, a ROM, and a RAM are included can be applied. Further, the CPU is an abbreviation of central processing unit. The ROM is an abbreviation of read only memory. The RAM is an abbreviation of random access memory.

The system control unit 30 functions as a general control unit that generally controls respective units of the inkjet recording device 10. The system control unit 30 functions as a calculation unit that performs various calculations.

Further, the system control unit 30 functions as a memory controller that controls writing of data to a storage device included in the inkjet recording device 10 and reading of data from the storage device.

The inkjet recording device 10 illustrated in FIG. 2 includes a communication unit 32. The communication unit 32 incudes a communication interface (not illustrated). The communication unit 32 can perform transmission and reception of data to and from a host computer 33 connected to the communication interface.

An image memory 34 functions as a temporary storage unit of various types of data including input image data. Data is written or read to or from the image memory 34 via the system control unit 30. Image data acquired from the host computer 33 via the communication unit 32 is temporarily stored in the image memory 34.

The inkjet recording device 10 illustrated in FIG. 2 includes a conveyance control unit 36. The conveyance control unit 36 controls an operation of the sheet conveyance unit 20. The conveyance control unit 36 controls conveyance start of the sheet 18 illustrated in FIG. 1, conveyance stop of the sheet 18, and a conveyance speed of the sheet 18.

The inkjet recording device 10 illustrated in FIG. 2 includes an image processing unit 38. The image processing unit 38 performs a color separation process, a color conversion process, a correction process, and halftone processing on the input image data acquired via the communication unit 32 to generate dot data.

That is, the image processing unit 38 includes a color separation processing unit, a color conversion processing unit, a correction processing unit, and a halftone processing unit. The color separation processing unit, the color conversion processing unit, the correction processing unit, and the halftone processing unit are not illustrated.

In the color separation processing unit, a color separation process is performed on the input image data. For example, in a case where the input image data is represented in RGB, the input image data is separated into data for each of colors R, G, and B. Here, R represents red. G represents green. B represents blue.

In the color conversion processing unit, image data for each color separated into to R, G, and B is converted into C, M, Y, and K corresponding to ink colors. Here, C represents cyan, M represents magenta. Y represents yellow. K represents the black.

In the correction processing unit, a correction process is performed on the image data for each color converted into C, M, Y, and K. Examples of the correction process include a gamma correction process, a concentration non-uniformity correction process, an abnormal recording element correction process, and the like.

In the halftone processing unit, for example, image data represented in a multi-gradation number such as 0 to 255 is converted into dot data represented by a two-value or a multi-value equal to or greater than three-value which is smaller than the number of gradations of input image data.

For the halftone processing unit, a predetermined halftone processing rule is applied. An example of the halftone processing rule includes a dither method, an error diffusion method, or the like. The halftone processing rule may be changed according to an image recording condition, content of the image data, or the like.

The inkjet recording device 10 illustrated in FIG. 2 includes a waveform generation unit 40, a waveform storage unit 42, and a head driving unit 44. The waveform generation unit 40 generates a driving waveform that is a waveform of the driving voltage that is supplied to the ejection elements included in the inkjet head 12. The driving waveform generated using the waveform generation unit 40 is stored in the waveform storage unit 42. The ejection element is not illustrated in FIG. 2.

A waveform input unit to which a driving wavefonn generated in the outside of the device is input may be included in place of the waveform generation unit 40 illustrated in FIG. 2. The driving waveform input using the waveform input unit is stored in the waveform storage unit 42.

Reading of driving waveform data indicating the driving waveform from the waveform storage unit 42 is an aspect of driving waveform acquisition using a driving waveform acquisition unit.

The head driving unit 44 serves as a driving voltage generation unit that generates a driving voltage that is supplied to each of the plurality of ejection elements included in the inkjet head 12. Further, the head driving unit 44 functions as a driving voltage supply unit that supplies the driving voltage to each of the plurality of ejection elements included in the inkjet head 12.

In this case, the supply of the driving voltage indicates an operation of the head driving unit 44. The head driving unit 44 will be described below in detail.

The inkjet recording device 10 illustrated in FIG. 2 includes a parameter storage unit 46, and a program storage unit 48.

The parameter storage unit 46 stores various parameters that are used in the inkjet recording device 10. The various parameters stored in the parameter storage unit 46 are read via the system control unit 30 and set to the respective units.

The program storage unit 48 stores programs used in the respective units of the inkjet recording device 10. Various programs stored in the program storage unit 48 are read via the system control unit 30 and executed in the respective units of the device.

The inkjet recording device 10 illustrated in FIG. 2 includes a detection information acquisition unit 49. The detection information acquisition unit 49 acquires detection information in the short-circuit detection. Known data communication can be applied to the acquisition of the detection information in the short-circuit detection.

Examples of the known data communication may include wired data communication, and wireless data communication. An aspect in which the storage device that stores the detection information is used is also possible.

Further, the respective units are listed according to functions in FIG. 2. The respective units illustrated in FIG. 2 can be appropriated integrated, separated, combined, or omitted. Further, the respective units illustrated in FIG. 2 can be configured in appropriate combination of hardware and software.

<Description of Head Driving Unit>

Figure 3:
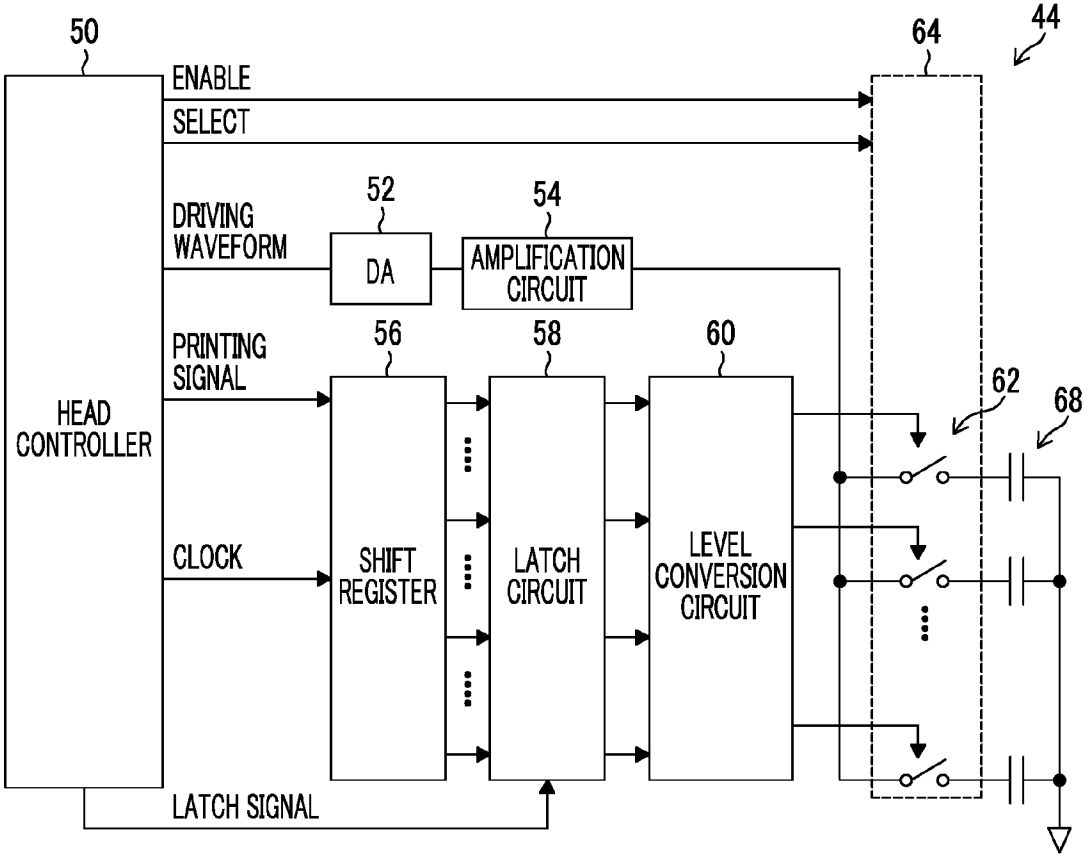
FIG. 3 is a block diagram illustrating a schematic configuration of a head driving unit.

FIG. 3 is a block diagram illustrating a schematic configuration of the head driving unit. The head driving unit 44 illustrated in FIG. 3 includes a head controller 50, a digital-to-analog conversion circuit 52, an amplification circuit 54, a shift register 56, a latch circuit 58, and a level conversion circuit 60. D of DA of the digital-to-analog conversion circuit 52 illustrated in FIG. 3 represents digital. Further, A of DA represents analog.

The head controller 50 reads the driving waveform stored in the waveform storage unit 42 illustrated in FIG. 2, and sends a digital signal indicating the driving waveform to the digital-to-analog conversion circuit 52.

The digital-to-analog conversion circuit 52 converts the driving waveform of the digital signal to a driving waveform of an analog signal. The driving waveform converted into the analog signal is sent to the amplification circuit 54.

The amplification circuit 54 voltage-amplifies and current-amplifies the driving waveform in an analog format to generate a driving voltage. The driving voltage generated through the voltage amplification and the current amplification in the amplification circuit 54 is sent to a driving voltage input terminal of each switch element 62 that is electrically connected to a driving electrode of each ejection element 68.

Further, the head controller 50 sends a print signal in a serial format to the shift register 56 in synchronization with a clock signal. Further, the head controller 50 sends a latch signal to the latch circuit 58.

The shift register 56 stores the print signal that is sent from the head controller 50 and is used to select one or more waveform elements from among a plurality of waveform elements included in the driving waveform. The print signal stored in the shift register 56 is read to the latch circuit 58 on the basis of the latch signal.

The latch circuit 58 sends the print signal read from the shift register 56 to the level conversion circuit 60. The level conversion circuit 60 converts the print signal sent from the latch circuit 58 into a voltage that can be applied to the switch element 62.

One or more waveform elements are selected from among the plurality of waveform elements included in the driving waveform on the basis of the print signal converted by the level conversion circuit 60. The plurality of waveform elements correspond to the ejection amount of the ink. For example, if three types of waveform elements are included in the driving waveform, the ejection amount of ink can be changed in three steps.

The switch element integrated circuit 64 includes a plurality of switch elements 62. The switch element integrated circuit 64 switches on or off each switch element 62 using an enable signal sent and a selection signal from the head controller 50.

The head driving unit 44 illustrated in FIG. 3 transmits a driving voltage common to the respective ejection elements 68 to the plurality of switch elements 62 that are electrically connected to the respective ejection elements 68. When each switch element 62 is turned ON on the basis of a driving signal indicating an ejection timing of the ejection element 68 electrically connected thereto, and a driving signal corresponding to the ink ejection amount, a driving voltage corresponding to each ink ejection amount of each ejection element 68 is supplied at each ejection timing for the ejection element 68.

A scheme of driving the inkjet head 12 described with reference to FIG. 3 is one example and, for example, a scheme of generating a driving voltage for each ejection element can be applied in an inkjet head having a relatively small number of ejection elements.

The respective units are listed according to functions in FIG. 3. The respective units illustrated in FIG. 3 can be appropriately integrated, separated, combined, or omitted. Further, the respective units illustrated in FIG. 3 can be configured in appropriate combination of hardware and software.

<Description of Ejection Element>

FIG. 4 is a cross-sectional view illustrating a configuration example of the ejection element. FIG. 4 is a cross-sectional view illustrating a three-dimensional structure of the ejection element 68 that is a minimum unit of ink ejection. The ejection element 68 illustrated in FIG. 4 includes a nozzle unit, and a piezoelectric element 88. The nozzle unit includes a nozzle opening 80, a pressure chamber 84, a vibration plate 86, and a supply port 90.

The nozzle opening 80 is formed in a nozzle plate 82. A surface opposite to a vibration plate 86 of the nozzle plate 82 is a liquid ejection surface. The nozzle opening 80 communicates with the pressure chamber 84. The pressure chamber 84 temporarily stores ink that is ejected from the nozzle opening 80.

The pressure chamber 84 communicates with a common flow path 92 through the supply port 90. The supply port 90 is a flow path that causes the pressure chamber 84 to communicate with the common flow path 92, and has a diameter smaller than an outlet on the nozzle opening 80 side of the pressure chamber 84.

The supply port 90 functions as a diaphragm on the supply side of the pressure chamber 84. The common flow path 92 communicates with the tube 14 illustrated in FIG. 1 through an ink flow path (not illustrated). The vibration plate 86 is bonded on the surface opposite to the nozzle opening 80 of the pressure chamber 84. The piezoelectric element 88 is bonded on a surface of the vibration plate 86 opposite to the pressure chamber 84.

The piezoelectric element 88 includes an upper electrode 94, a piezoelectric body 98, and a lower electrode 96. The piezoelectric element 88 has a structure in which the piezoelectric body 98 is sandwiched between the upper electrode 94 and the lower electrode 96. The lower electrode 96 can also be used as the vibration plate 86. The piezoelectric element is an aspect of a pressure generation element.

Although not illustrated, a plane shape of the pressure chamber 84 provided corresponding to the nozzle opening 80 is a substantially a square, an outlet directed to the nozzle opening 80 is provided at one of two corners on a diagonal line, and the supply port 90 that is an inlet of supply ink is provided at the other of the corners.

Further, the planar shape of the pressure chamber 84 is not limited to the square. A variety of forms such as a rectangle, a pentagon, a hexagon, other polygons, a circular shape, and an elliptic shape can be applied as the planar shape of the pressure chamber 84.

In the ejection element 68, droplet-like ink can be ejected from each nozzle opening 80 by controlling driving of the piezoelectric element 88 corresponding to each nozzle opening 80 according to the dot data generated from the input image data.

A desired image is formed on the sheet 18 by controlling a timing at which the droplet-like ink is ejected from the nozzle opening 80 illustrated in FIG. 4 according to the conveyance speed of the sheet 18 while conveying the sheet 18 illustrated in FIG. 1 in the sheet conveyance direction at a constant speed.

For the ejection element 68 illustrated in FIG. 4, a structure in which a plurality of cavity plates are stacked can be applied. The ejection element 68 illustrated in FIG. 4 has a structure in which a nozzle plate 82 in which a nozzle opening 80 is formed, a flow path plate 99 in which a pressure chamber 84, a supply port 90, a common flow path 92, and the like are formed, a vibration plate 86, and a piezoelectric element 88 are stacked in an order of the nozzle plate 82, the flow path plate 99, the vibration plate 86, and the piezoelectric element 88. The flow path plate 99 may be further subdivided.

Although a piezoelectric scheme in which the piezoelectric element 88 is applied as means for pressurizing the ink stored in the pressure chamber 84 is illustrated in this embodiment, a thermal scheme in which a heater that heats ink in the inside of the pressure chamber 84 is included and the ink is pressurized using a film boiling phenomenon of the ink can be applied. The heater is an aspect of a pressure generation element.

[Description of Short-Circuit Detection According to First Embodiment]

Next, short-circuit detection according to the first embodiment will be described.

<Structure Example of Inkjet Head>

Figure 5:
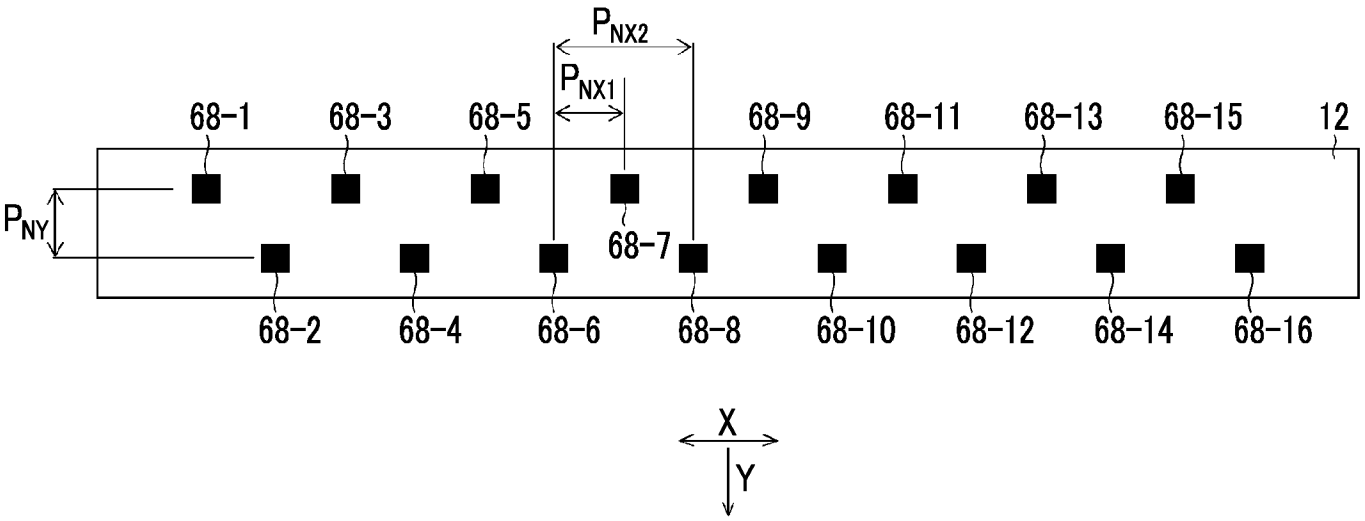
FIG. 5 is a perspective plan view of a liquid ejection surface of an inkjet head.

FIG. 5 is a perspective plan view of a liquid ejection surface of the inkjet head. For ease of description, sixteen ejection elements 68 among the plurality of ejection elements 68 are illustrated in FIG. 5.

A sub-number assigned to reference sign 68 indicating the ejection element is an identification number of the sixteen ejection elements 68, and corresponds to an arrangement order in the sheet width direction. In the following description, in a case where it is not necessary to distinguish among the ejection elements 68-1 to 68-16 illustrated in FIG. 5, the ejection elements are described as the ejection element 68. Further, the ejection element 68 illustrated in FIG. 5 can be replaced with the nozzle opening 80 or the piezoelectric element 88 illustrated in FIG. 4.

In the inkjet head 12 illustrated in FIG. 5, a plurality of ejection elements 68 are arranged in two columns in the sheet conveyance direction. The ejection elements 68 belonging to one column and the ejection elements 68 belonging to the other column are arranged at equal intervals in the sheet conveyance direction.

For example, the ejection elements 68 belonging to the one column are an ejection element 68-1, an ejection element 68-3, an ejection element 68-5, an ejection element 68-7, an ejection element 68-9, an ejection element 68-11, an ejection element 68-13, and an ejection element 68-15.

Further, the ejection element 68 belonging to the other column are an ejection element 68-2, an ejection element 68-4, an ejection element 68-6, an ejection element 68-8, an ejection element 68-10, an ejection element 68-12, an ejection element 68-14, and an ejection element 68-16.

An arrangement interval $P_{NX1}$ of the ejection elements 68 in the sheet width direction in a case where the ejection elements 68-1 to 68-16 illustrated in FIG. 5 are projected in the sheet width direction is an equal interval. The arrangement interval $P_{NX1}$ of the ejection elements 68 in a case where the ejection elements 68-1 to 68-16 are projected in the sheet width direction is ½ of an arrangement interval $P_{NX2}$ of the ejection elements 68 in each column in the sheet width direction.

In a case where a maximum resolution of the image is 600 dots per inch, the arrangement interval $P_{NX2}$ of the ejection elements of each column in the sheet width direction is 84 micrometers. The arrangement interval $P_{NX1}$ of the ejection elements 68 in the sheet width direction in a case where the ejection elements 68-1 to 68-16 illustrated in FIG. 5 are projected in the sheet width direction is 42 micrometers.

The arrangement interval $P_{NY}$ of the ejection elements 68 in the sheet conveyance direction is 84 micrometers. Numeric values indicating the arrangement interval $P_{NX1}$, the arrangement interval $P_{NX2}$, and the arrangement interval $P_{NY}$ are numerical values obtained by rounding off a first decimal place.

The arrangement of the plurality of ejection elements 68 illustrated in FIG. 5 is an aspect of a matrix arrangement. Another example in which the plurality of ejection elements 68 are arranged in a matrix form may include an example in which the plurality of ejection elements 68 are arranged in a row direction along a longitudinal direction of the inkjet head 12 and an oblique column direction intersecting the longitudinal direction of the inkjet head 12.

Further, the longitudinal direction of the inkjet head 12 corresponds to the sheet width direction in a state in which the inkjet head 12 is used. A lateral direction of the inkjet head 12 corresponds to the sheet conveyance direction in a state in which the inkjet head 12 is used.

The same applies to the following description. In the following description, for the sake of convenience, the longitudinal direction of the inkjet head 12 is denoted with a reference sign X. Further, the lateral direction of the inkjet head 12 is denoted with a reference sign Y. The same applies to FIGS. 6 to 8.

An inkjet head having a structure in which a plurality of head modules are included and the plurality of head modules are arranged in the longitudinal direction of the inkjet head may be applied. The plurality of head modules may be arranged in a line or may be arranged in two or more lines.

For the head module, a planar shape of a parallelogram having end surfaces on the long side in a direction having an inclination with respect to a longitudinal direction of the inkjet head 12, and end surfaces on the short side in a direction having an inclination with respect to the lateral direction of the inkjet head 12 can be applied.

Another example in which the plurality of ejection elements 68 are arranged in a matrix form may include an example in which a plurality of nozzle openings 80 are arranged in a row direction along a direction of an end surface on the long side and a column direction along a direction of the end surface of the short side.

Figure 6:
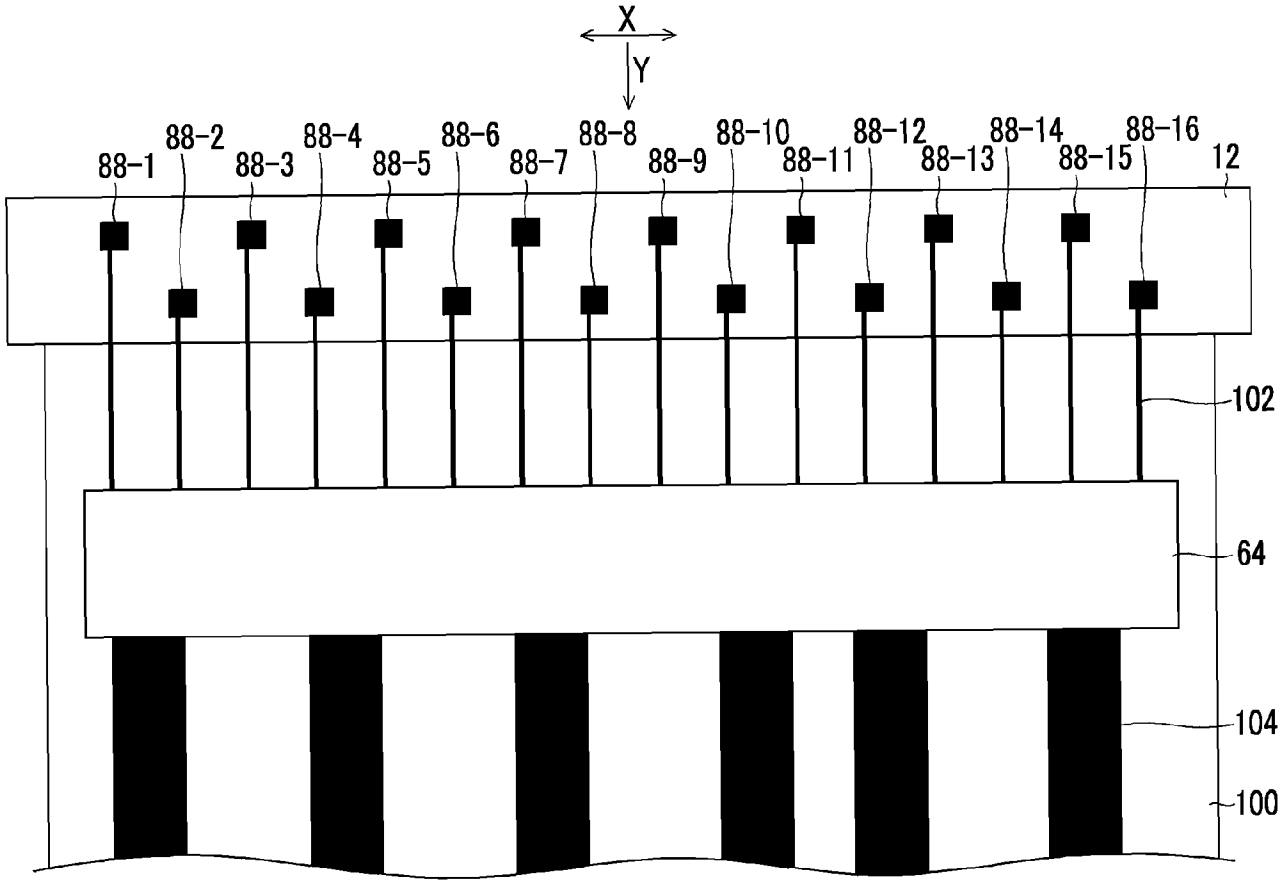
FIG. 6 is an illustrative diagram schematically illustrating electrical wirings of ejection elements.

FIG. 6 is an illustrative diagram schematically illustrating electrical wirings of the ejection elements. In FIG. 6, the piezoelectric elements 88-1 to 88-16 corresponding to the respective ejection elements 68-1 and 68-16 are illustrated instead of the ejection elements 68-1 and 68-16 illustrated in FIG. 5.

The sub-number added to the reference sign 88 indicating the piezoelectric element is an identification number of the piezoelectric elements 88, and corresponds to an arrangement order in the sheet width direction, similar to the sub-number added to the reference sign 68 indicating the ejection element illustrated in FIG. 5. In the following description, in a case where it is not necessary to distinguish among the piezoelectric elements 88-1 to 88-16 illustrated in FIG. 6, the piezoelectric elements 88-1 to 88-16 are described as the piezoelectric element 88. The electrical wiring may include an electrode, a pad, or a through hole.

The inkjet head 12 is electrically connected to an electrical circuit board on which the head driving unit 44 illustrated in FIGS. 2 and 3 is mounted, using a flexible substrate 100. The switch element integrated circuit 64 illustrated in FIG. 3 is mounted on the flexible substrate 100. The electrical circuit board is not illustrated.

The flexible substrate 100 illustrated in FIG. 6 is electrically connected to a driving voltage output terminal of the switch element integrated circuit 64, and an electrical wiring 102 that electrically connects an electrode mechanically bonded to the driving voltage output terminal of the switch element integrated circuit 64 to the upper electrode of each piezoelectric element 88 is formed. In FIG. 6, the upper electrode of each piezoelectric element 88 is not illustrated. The upper electrode of the piezoelectric element 88 is denoted ah the reference sign 94 and illustrated in FIG. 4.

In FIG. 6, only one of the plurality of illustrated electrical wirings 102 is denoted with a reference sign. Further, the driving voltage output terminals of the switch element integrated circuit 64 are not illustrated in FIG. 6. The driving voltage output terminals of the switch element integrated circuit 64 are denoted with reference signs 65-1 to 65-16 and illustrated in FIG. 8.

In the flexible substrate 100 illustrated in FIG. 6, electrical wirings 104 for the driving voltage transferred from the head driving unit 44 illustrated in FIG. 3 to the switch element integrated circuit 64 are formed. In FIG. 6, only one of the plurality of illustrated electrical wirings 104 is denoted with a reference sign.

<Description of Short Circuit of Ejection Element>

Figure 7:
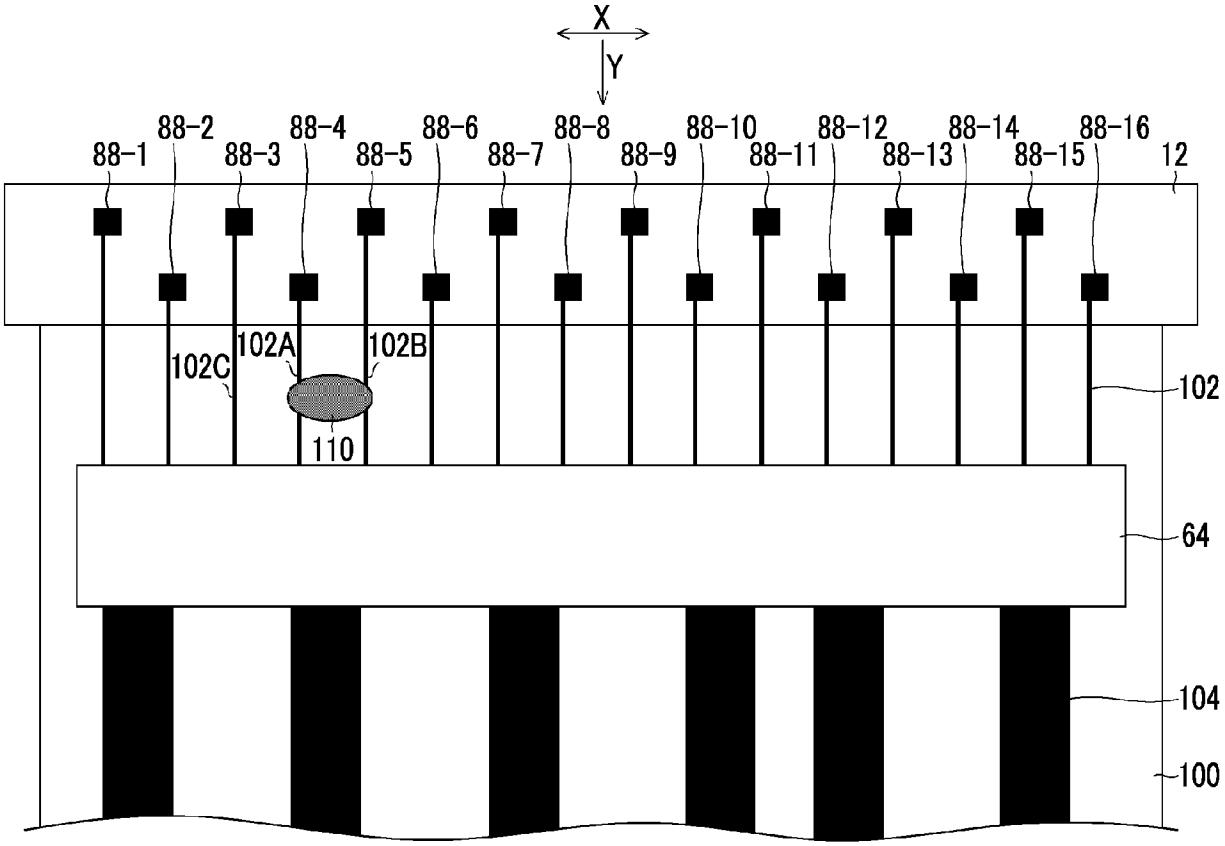
FIG. 7 is an illustrative diagram schematically illustrating a case where an electrical wiring is short-circuited.

FIG. 7 is an illustrative diagram schematically illustrating a case where an electrical wiring is short-circuited. In the inkjet head 12 illustrated in FIG. 7, a conductive material 110 comes in contact with an electrical wiring 102A that is electrically connected to the piezoelectric element 88-4 and an electrical wiring 102B that is electrically connected to the piezoelectric element 88-5, and the electrical wirings are short-circuited. The short circuit of the electrical wirings 102 that are electrically connected to the respective ejection elements 68 is synonymous with a short circuit of the ejection elements 68.

As illustrated in FIG. 7, if the electrical wiring 102A that is electrically connected to the piezoelectric element 88-4 and the electrical wiring 102B that is electrically connected to the piezoelectric element 88-5 are short-circuited, the piezoelectric element 88-5 may be driven at a timing at which the piezoelectric element 88-4 is driven.

Then, at a timing at which ink is ejected from the ejection element 68-4 including the piezoelectric element 88-4, ink is ejected from the ejection element 68-5 including the piezoelectric element 88-5.

Further, in a case where the piezoelectric element 88-5 is driven, ink is ejected from the ejection element 68-4 including the piezoelectric element 88-4 at a timing at which ink is ejected from the ejection element 68-5 including the piezoelectric element 88-5. In such a state, an image different from an image to be originally formed is formed.

Figure 8:
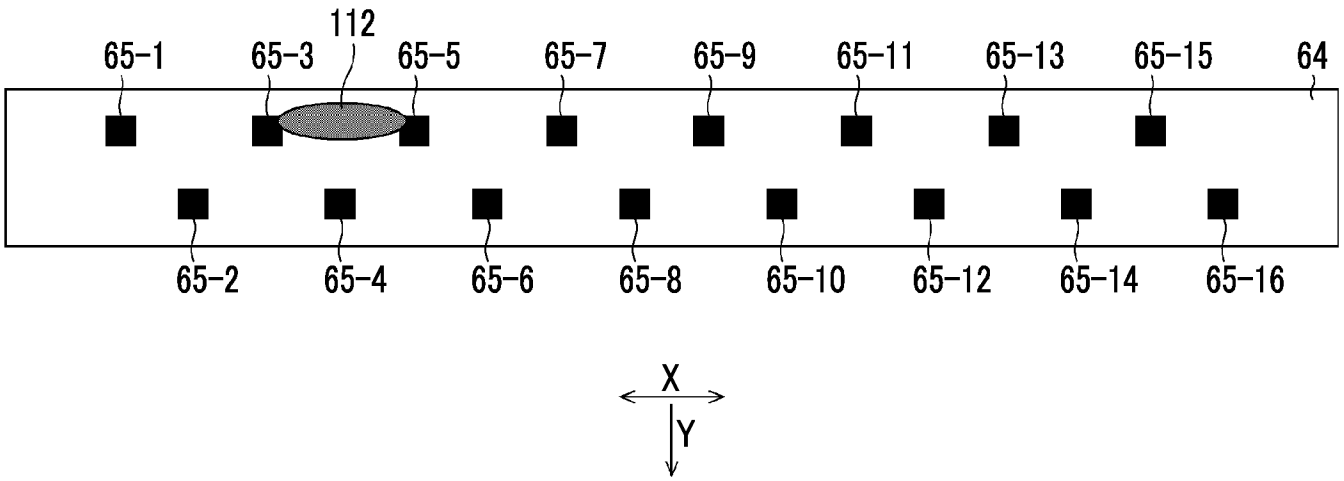
FIG. 8 is an illustrative diagram schematically illustrating a case where a driving voltage output terminal of a switch element integrated circuit is short-circuited.

FIG. 8 is an illustrative diagram schematically illustrating a case where the driving voltage output terminal of the switch element integrated circuit is short-circuited. FIG. 8 is a diagram of the driving voltage output terminals 65-1 to 65-16 seen through the switch element integrated circuit 64. In the following description, in a case where it is not necessary to distinguish among the driving voltage output terminals 65-1 to 65-16 illustrated in FIG. 8, the driving voltage output terminals are described as the driving voltage output terminal 65.

The switch element integrated circuit 64 illustrated in FIG. 8 is short-circuited due to attachment of a conductive material 112 to the driving voltage output terminal 65-3 and the driving voltage output terminal 65-5. The short circuit of the driving voltage output terminals 65 connected electrically to the respective ejection elements 68 is synonymous with the short circuit of the ejection elements 68.

In the switch element integrated circuit 64 illustrated in FIG. 8, even in a case where the driving voltage output terminal 65-3 and the driving voltage output terminal 65-5 are short-circuited, an image different from an image to be originally formed is formed.

As illustrated in this embodiment, in a case where the electrical wiring and the driving voltage output terminal are arranged with high density, a short circuit easily occurs between adjacent electrical wirings or between adjacent driving voltage output terminals.

An example of the driving voltage output terminal 65 illustrated in FIG. 8 may include a bonding portion of the switch element integrated circuit 64 that is an ASIC. Further, the ASIC is an abbreviation of Application Specific Integrated Circuit.

Similar to the driving voltage output terminal 65, it is easy for a short circuit to occur in electrodes that are electrically connected and mechanically bonded to the driving voltage output terminals 65. Even in a case where adjacent electrodes are short-circuited, an image different from an image to be originally formed may be formed.

Here, the adjacent electrical wirings may be adjacent inside of the inkjet head 12 even when the adjacent electrical wirings are not adjacent in the flexible substrate 100, like an electrical wiring 102C that is electrically connected to a piezoelectric element 88-3 and an electrical wiring 102B that is electrically connected to a piezoelectric element 88-5 illustrated in FIG. 7.

Further, the adjacent driving voltage output terminals may be adjacent in a direction orthogonal to a longitudinal direction of the inkjet head 12 or in an oblique direction intersecting the longitudinal direction of the inkjet head 12, like the driving voltage output terminal 65-3 and the driving voltage output terminal 65-4 illustrated in FIG. 8.

In a case where an image to be originally formed is not formed, a countermeasure in which the formed image is not allowed is possible. On the other hand, if the ejection element in which a short circuit occurs is specified, it is possible to increase a level of the countermeasure of the short circuit between the ejection elements.

An example in which the level of the countermeasure against the short circuit is increased may include an example in which the ejection element in which the short circuit has occurred is subjected to a non-use process. Since the ejection element in which the short circuit has occurred is subjected to the non-use process, it is possible to use the inkjet head. Further, it can be determined whether or not exchange of the inkjet head is required according to the number of ejection elements in which the short circuit occurs.

Further, by specifying a position of the short circuit, it is possible to improve a process of producing the inkjet head. Hereinafter, short-circuit detection will be described in detail.

<Description of Short-Circuit Detection Driving Voltage According to First Embodiment>

Figure 9:
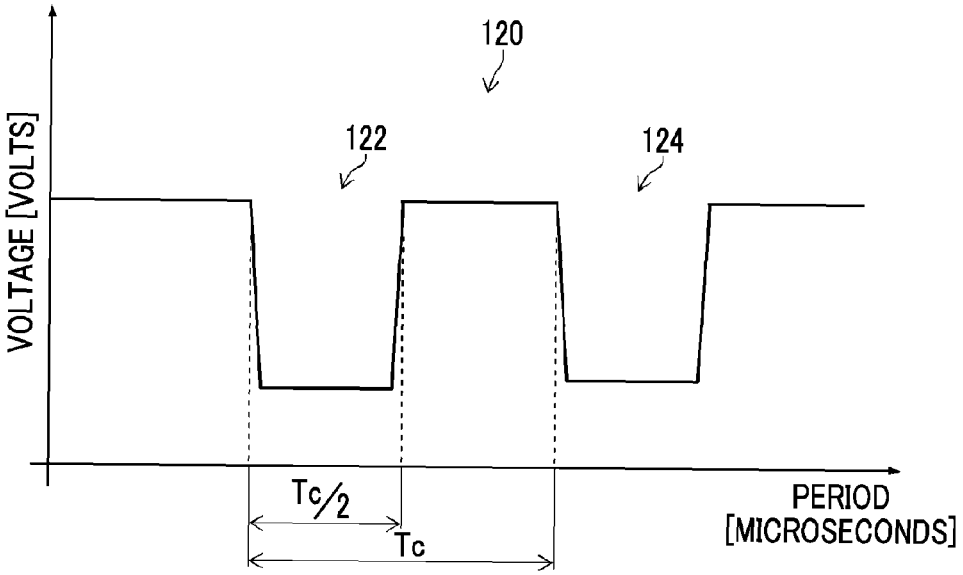
FIG. 9 is an illustrative diagram of a short-circuit detection driving voltage according to a first embodiment.

FIG. 9 is an illustrative diagram of a short-circuit detection driving voltage according to the first embodiment. A horizontal axis in FIG. 9 is a period. A unit of the period is a microsecond. Micro indicates $10^{-6}$. Further, a vertical series of FIG. 9 indicates a voltage. A unit of the voltage is a volt. The same applies to FIGS. 10, 11, 16, and 17. Further, an ejection elements (not illustrated) in the following description is the ejection element 68 illustrated in FIG. 4.

A driving waveform 120 illustrated in FIG. 9 includes a first waveform element 122 and a second waveform element 124. In the driving waveform 120, the first waveform element 122 and the second waveform element 124 do not overlap in time.

Further, in the driving waveform 120, a period from start of the first waveform element 122 to start of the second waveform element 124 is a resonance cycle $T_c$ of the ejection element. Further, a pulse width of the first waveform element 122 is ½ of the resonance cycle $T_c$ of the ejection element.

Here, as the pulse width of the first waveform element 122, a period from the start of the first waveform element 122 to end of the first waveform element 122 can be applied.

Figure 10:
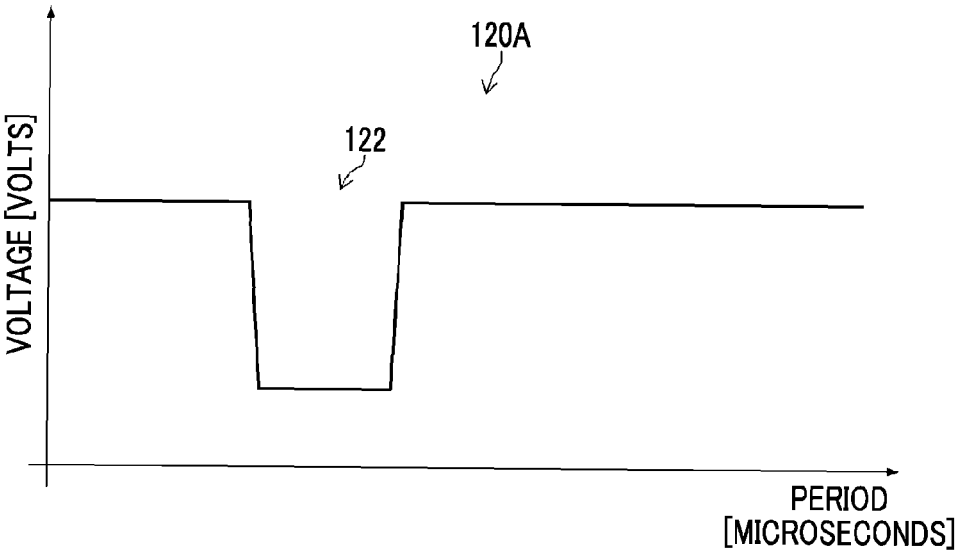
FIG. 10 is an illustrative diagram of a first waveform element.

FIG. 10 is an illustrative diagram of the first waveform element. A first driving voltage having a driving waveform 120A including the first waveform element 122 illustrated in FIG. 10 is a driving voltage that cannot cause ink to be ejected from the ejection element even when the driving voltage is applied to each ejection element alone.

The application of the driving voltage indicates a result of the supply of the driving voltage viewed from the ejection element. In a case where electrical abnormality such as a short circuit or an opened circuit occurs in an electrical wiring electrically connected to each ejection element, a driving voltage that is not supplied from the head driving unit 44 illustrated in FIG. 2 may be applied or a driving voltage to be supplied from the head driving unit 44 may not be applied.

Figure 11:
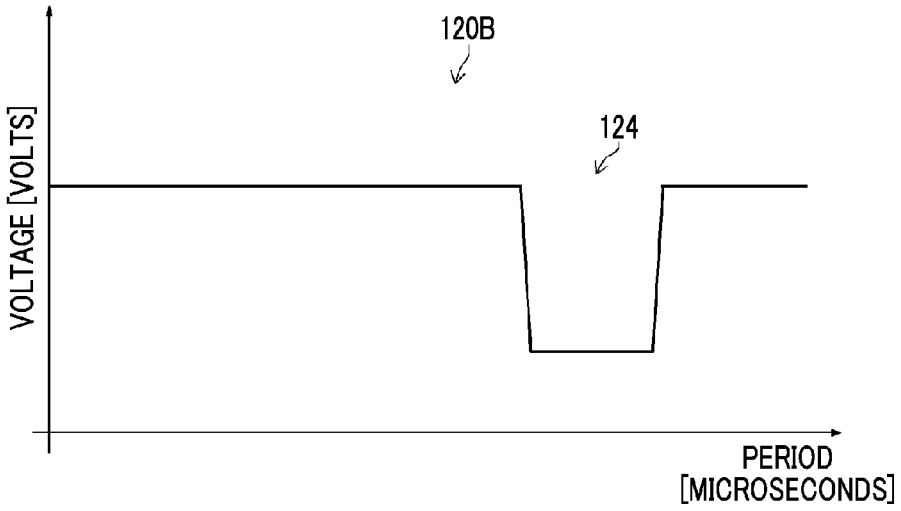
FIG. 11 is an illustrative diagram of a second waveform element.

FIG. 11 is an illustrative diagram of the second waveform element. A second driving voltage having a driving waveform 120B including a second waveform element 124 illustrated in FIG. 11 is a driving voltage that cannot cause ink to be ejected from the ejection element even when the driving voltage is applied to each ejection element alone.

An example of the driving voltage that cannot cause ink to be ejected from the ejection element may include a driving voltage having a potential difference smaller than a potential difference required to cause ink to be ejected from the ejection element.

A driving voltage having the driving waveform 120 illustrated in FIG. 9 is prepared. The first driving voltage having the driving waveform 120A including the first waveform element 122 illustrated in FIG. 10 is supplied to an ejection element that is a short-circuit detection target.

Further, the second driving voltage having the driving waveform 120B including the second waveform element 124 illustrated in FIG. 11 is supplied to an ejection element suspected of a short circuit with an ejection element that is a short-circuit detection target. Hereinafter, the ejection element that is a short-circuit detection target is described as a first ejection element. Further, the ejection element suspected of a short circuit with the ejection element that is a short-circuit detection target is described as the second ejection element.

For the ejection element suspected of a short circuit with the ejection element that is a short-circuit detection target, an ejection element arranged in a position adjacent to the ejection element that is a short-circuit detection target can be applied. The position adjacent to the ejection element that is a short-circuit detection target may be an adjacent position in the longitudinal direction of the inkjet head 12.

The position adjacent to the ejection element that is a short-circuit detection target may be an adjacent position in the lateral direction of the inkjet head 12 that is a direction orthogonal to the longitudinal direction of the inkjet head 12 or may be an adjacent position in an oblique direction intersecting the longitudinal direction of the inkjet head 12 and the lateral direction of the inkjet head 12.

In a case where a short circuit between the first ejection element and the second ejection element does not occur, ink is not ejected from both of the first ejection element and the second ejection element. On the other hand, in a case where the short circuit between the first ejection element and the second ejection element occurs, the ink is ejected from both of the first ejection element and the second ejection element.

Whether or not there is ejection of the first ejection element and the second ejection element in the case where a short circuit between the first ejection element and the second ejection element does not occur and whether or not there is ejection of the first ejection element and the second ejection element in the case where the short circuit between the first ejection element and the second ejection element occurs are shown in [Table 1].

TABLE 1

| | First driving waveform | Second driving waveform | Ejection |
|---|---|---|---|
| Arbitrary normal ejection element | Application | Non-application | Not performed |
| Another normal ejection element | Non-application | Application | Not performed |
| Ejection element in which short circuit occurs | Application | Application | Performed |

Arbitrary normal ejection element in [Table 1] is the first ejection element when the short circuit between the first ejection element and the second ejection element does not occur. Further, another normal ejection element in [Table 1] is a second ejection element in which the short circuit between the first ejection element and the second ejection element does not occur.

The ejection elements in which a short circuit occurs in [Table 1] are the first ejection element and the second ejection element in a case where a short circuit between the first ejection element and the second ejection element occurs.

As illustrated in FIG. 9, a period from start of the first waveform element 122 to start of the second waveform element 124 is a resonance cycle $T_c$ of the ejection element. Accordingly, in a case where a short circuit between the first ejection element and the second ejection element occurs, it is easier to eject the link from the first ejection element and the second ejection element.

That is, since the first driving voltage having the driving waveform 120A including the first waveform element 122 is applied, the ink is pressurized to the extent of non-ejection of ink. The second driving voltage having the driving waveform 120B including the second waveform element 124 is applied after the resonance cycle $T_c$ of the ejection element has elapsed from the start of the first waveform element 122. Accordingly, since the ink is pressurized at a timing at which it is easy for the ink to be ejected, it is easy for the ink to be ejected from the first ejection element and the second ejection element.

A period from the start of the first waveform element 122 to the start of the second waveform element 124 illustrated in FIG. 9 can be a period having a lower limit value calculated by multiplying the resonance cycle $T_c$ of the ejection element by a constant $\alpha_1$ and an upper limit value calculated by multiplying the resonance cycle $T_c$ of the ejection element by a constant $\alpha_2$.

The period from the start of the first waveform element 122 to the start of the second waveform element 124 corresponds to a period from the start of the first driving voltage to the start of the second driving voltage.

The constant $\alpha_1$ and the constant $\alpha_2$ may be determined from a condition under which ink can be ejected from the first ejection element and the second ejection element in a case where a short circuit between the first ejection element and the second ejection element occurs.

There is a relationship of constant $\alpha_1$<constant $\alpha_2$. For example, for the constant $\alpha_1$ and the constant $\alpha_2$, $0.5<\alpha_1<1.0$ and $1.0<\alpha_2<1.5$.

<Observation of Ejection State of Ink>

Figure 12:
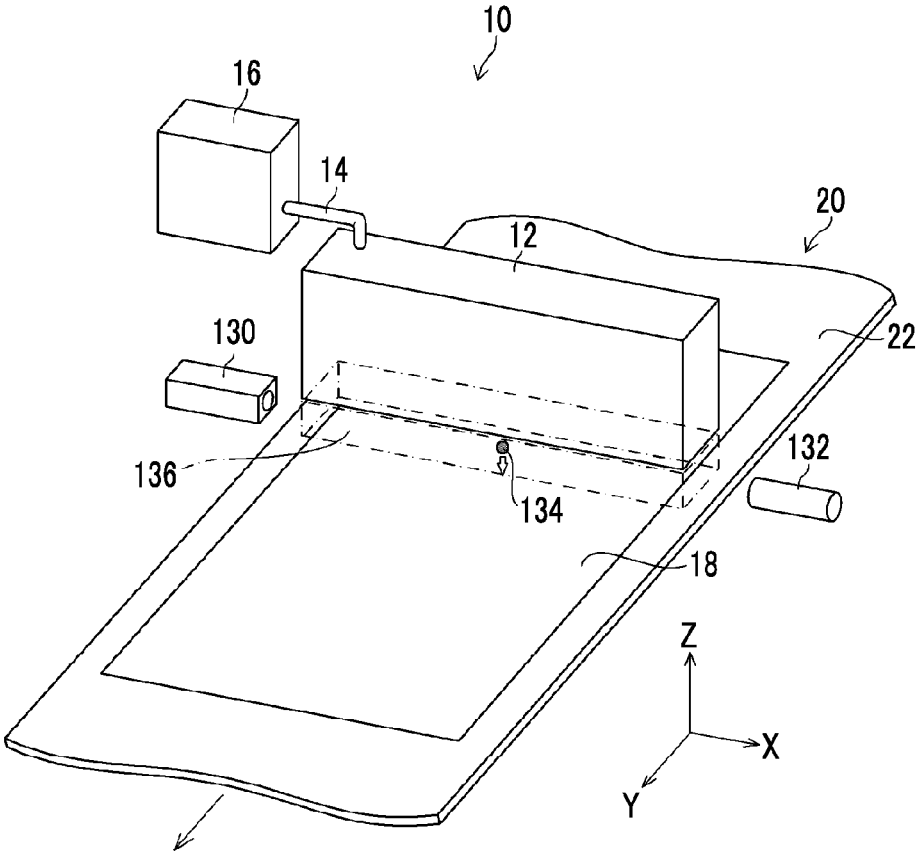
FIG. 12 is an illustrative diagram of an example of observation of an ejection state of ink according to the first embodiment.

FIG. 12 is an illustrative diagram illustrating an example of observation of an ejection state of the ink according to the first embodiment. In the example illustrated in FIG. 12, in a period in which the first driving voltage is supplied to the first ejection element and the second driving voltage is supplied to the second ejection element, a liquid passage area 136 through which droplet-like ink 134 ejected from the inkjet head 12 passes is imaged using an imaging device 130 and a light source 132.

An example of the imaging device 130 may include an imaging device including an image sensor. For the image sensor, a CCD image sensor or a CMOS image sensor can be applied. Further, the CCD is an abbreviation of a Charge Coupled Device. The CMOS is an abbreviation of a Complementary Metal-Oxide Semiconductor.

The light source irradiates the liquid passage area 136 with illumination light. The illumination light may satisfy an imaging condition of the imaging device 130, and a type of the illumination light is not limited.

In a case where the droplet-like ink 134 is imaged using the imaging device 130, it is possible to determine that a short circuit between the first ejection element and the second ejection element occurs. On the other hand, in a case where the droplet-like ink 134 is not imaged using the imaging device 130, it is possible to determine that a short circuit between the first ejection element and the second ejection element does not occur.

Imaging data acquired using the imaging device 130 is acquired using the detection information acquisition unit 49 illustrated in FIG. 2. For communication of the imaging data from the imaging device 130 illustrated in FIG. 12 to the detection information acquisition unit 49 illustrated in FIG. 2, known data communication can be applied. The detection information acquisition unit 49 is aspect of the imaging data acquisition unit.

The observation of the ejection state of the ink illustrated in FIG. 12 may be executed in a state in which the liquid passage area 136 is further widened by moving the inkjet head 12 in an upward direction relative to the arrangement at the time of drawing.

Figure 13:
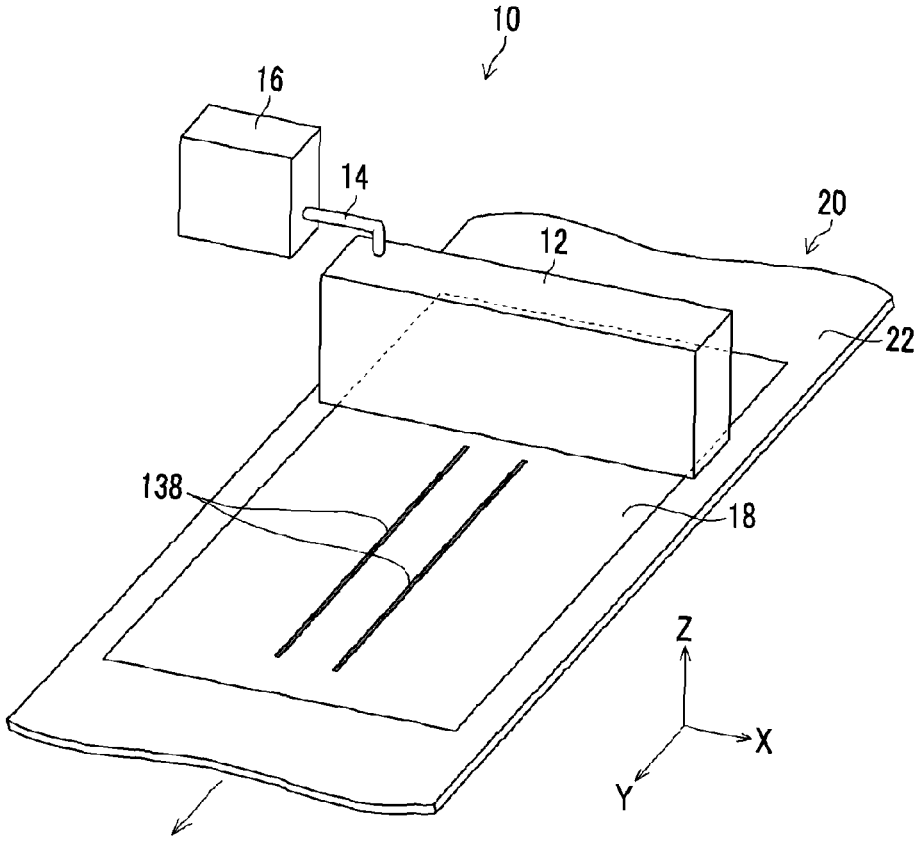
FIG. 13 is an illustrative diagram of another example of the observation of the ejection state of the ink according to the first embodiment.

FIG. 13 is an illustrative diagram of another example of the observation of the ejection state of the ink according to the first embodiment. In the example illustrated in FIG. 13, the sheet 18 is conveyed in the sheet conveyance direction, the first driving voltage is supplied to the first ejection element, and the second driving voltage is supplied to the second ejection element.

In a case where a short circuit between the first ejection element and the second ejection element occurs, a dot array 138 illustrated in FIG. 13 is formed. On the other hand, when a short circuit between the first ejection element and the second ejection element does not occur, the dot array 138 illustrated in FIG. 13 is not formed.

That is, by observing whether or not the dot array 138 is formed on the sheet 18, it is possible to determine whether or not a short circuit between the first ejection element and the second ejection element occurs.

For the observation of whether or not there is the dot array 138 formed on the sheet 18, visual inspection of an operator can be applied. In a case where whether or not there is the dot array 138 formed on the sheet 18 is observed using the visual inspection of the operator, observation information input by the operator is acquired using the detection information acquisition unit 49 illustrated in FIG. 2. The detection information acquisition unit 49 is an aspect of an observation result information acquisition unit.

For the observation of whether or not there is the dot array 138 formed on the sheet 18, imaging using an imaging device can be applied. In a case where whether or not there is the dot array 138 formed on the sheet 18 is observed using the imaging device, imaging data obtained using the imaging device is acquired using the detection information acquisition unit 49 illustrated in FIG. 2. For the imaging device, the same imaging device as the imaging device 130 described above can be applied.

Figure 14:
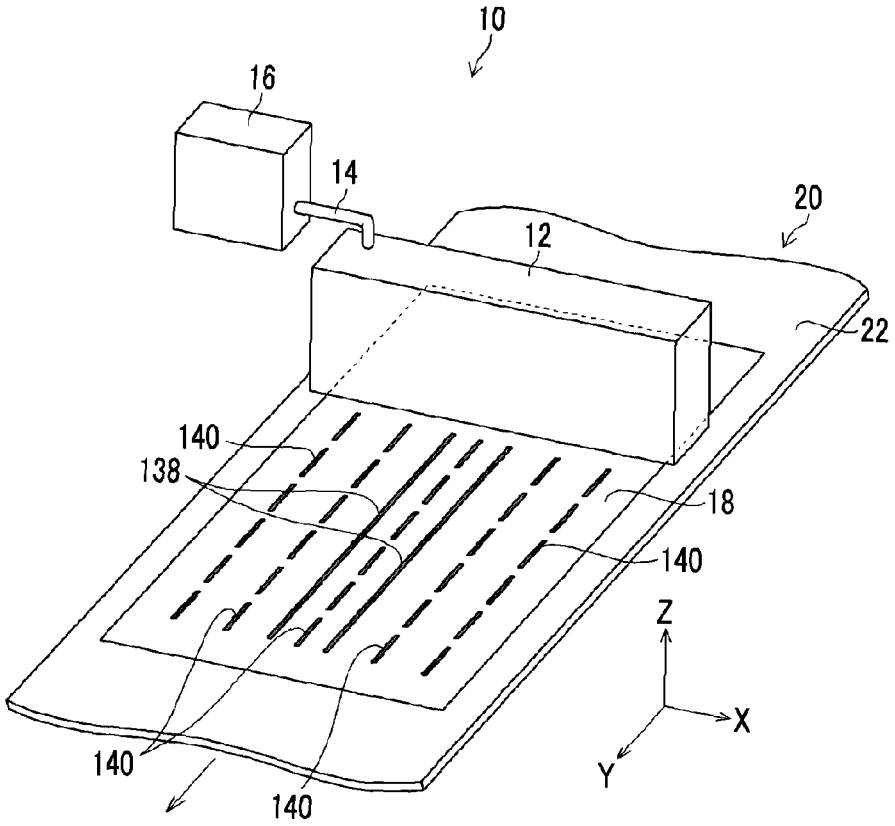
FIG. 14 is an illustrative diagram of a modification example of the observation of the ejection state of the ink illustrated in FIG. 13.

FIG. 14 is an illustrative diagram of a modification example of the observation of the ejection state of the ink illustrated in FIG. 13. In the modification example illustrated in FIG. 14, addition of a plurality of dot arrays 140 using normal ejection elements other than the first ejection element and the second ejection element is added to the observation of the ejection state of the ink illustrated in FIG. 13.

The plurality of dot arrays 140 illustrated in FIG. 14 are formed at regular intervals in the sheet width direction. For example, in detection of a short circuit of the inkjet head including hundred ejection elements, a driving voltage by which the dot array 140 is formed for each ten ejection elements is supplied.

That is, the plurality of dot arrays 140 illustrated in FIG. 14 function as a scale in the sheet 18. By forming the plurality of dot arrays 140, specifying of positions of the first ejection element and the second ejection element is facilitated.

Although the aspect in which whether or not there is ejection of the first ejection element and the second ejection element is observed is illustrated in the observation of the ejection state of the ink described above, it is possible to detect the short circuit between the first ejection element and the second ejection element by observing whether or not there is at least the ejection of the first ejection element.

<Procedure of Short-Circuit Detection Method>

Figure 15:
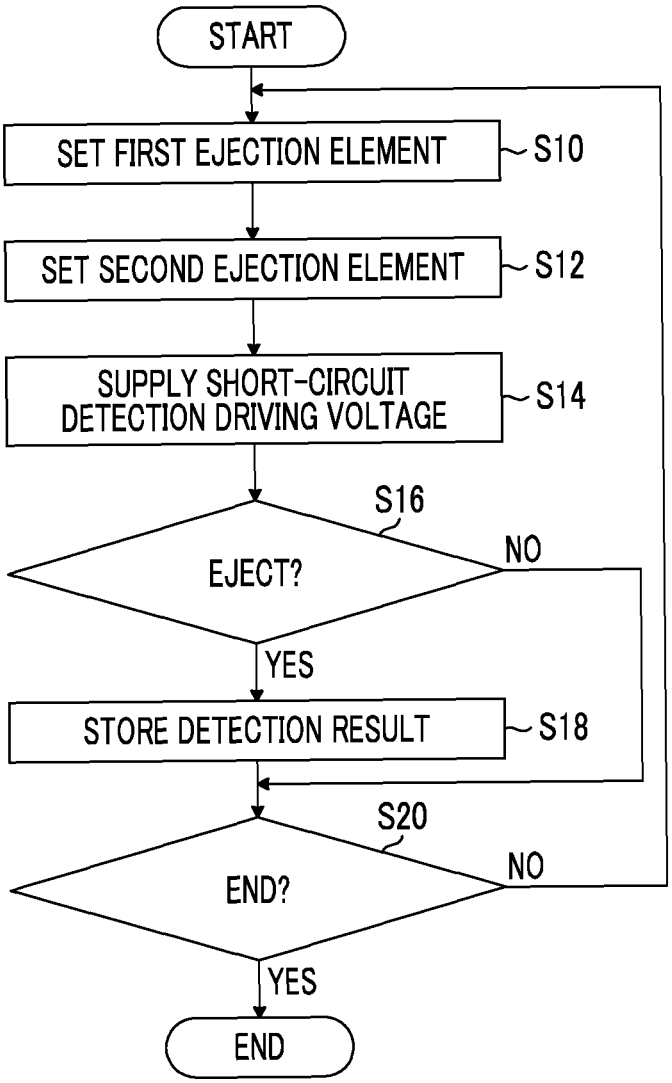
FIG. 15 is a flowchart illustrating a flow of a procedure of a short-circuit detection method according to the first embodiment.

FIG. 15 is a flowchart illustrating a flow of a procedure of the short-circuit detection method according to the first embodiment. If short-circuit detection is started, the first ejection element is set in a first ejection element setting step S10. Further, in a second ejection element setting step S12, a second ejection element is set.

After the first ejection element is set in the first ejection element setting step S10 and the second ejection element is set in the second ejection element setting step S12, the process proceeds to a short-circuit detection driving voltage supply step S14.

In the short-circuit detection driving voltage supply step S14, the first driving voltage having the driving waveform 120A including the first waveform element 122 illustrated in FIG. 10 is generated. Further, in the short-circuit detection driving voltage supply step S14 illustrated in FIG. 15, the second driving voltage having the driving waveform 120B including the second waveform element 124 illustrated in FIG. 11 is generated.

In the short-circuit detection driving voltage supply step S14 illustrated in FIG. 15, the first driving voltage having the driving waveform 120A including the first waveform element 122 illustrated in FIG. 10 is supplied to the first ejection element. Further, in the short-circuit detection driving voltage supply step S14 illustrated in FIG. 15, the second driving voltage having the driving waveform 120B including the second waveform element 124 illustrated in FIG. 11 is supplied to the second ejection element, and then, the process proceeds to an ejection state observation step S16 illustrated in FIG. 15.

An order of the supply of the first driving voltage to the first ejection element and the supply of the second driving voltage to the second ejection element is not limited. The supply of the first driving voltage to the first ejection element may be performed, and then, the supply of the second driving voltage to the second ejection elements may be performed. On the other hand, the supply of the second driving voltage to the second ejection element may be performed, and then, the supply of the first driving voltage to the first ejection element may be performed.

In an ejection state observation step S16, the ejection state of the ink is observed. In the ejection state observation step S16, in a case where an observations result indicating that the ink is not ejected is acquired, a result of the observation is a No determination. In the case of the No determination, the process proceeds to an end determination step S20. In the case of the No determination, an aspect in which the process proceeds to the detection result storage step S18 is possible.

On the other hand, in the ejection state observation step S16, in a case where an observations result indicating that the ink is ejected is acquired, a result of the observation is a Yes determination. In the case of the Yes determination, the process proceeds to the detection result storage step S18.

In a case where the observation of the ejection state illustrated in FIG. 12 is applied in the ejection state observation step S16, the process proceeds to the ejection state observation step S16 illustrated in FIG. 15 during a period in which the first driving voltage having the driving waveform 120A including the first waveform element 122 illustrated in FIG. 10 is supplied to the first ejection element, and the second driving voltage having the driving waveform 120B including the second waveform element 124 illustrated in FIG. 11 is supplied to the second ejection element in the short-circuit detection driving voltage supply step S14 illustrated in FIG. 15.

In the detection result storage step S18, identification information of the first ejection element and the second ejection element is stored. After the identification information of the first ejection element and the second ejection element is stored in the detection result storage step S18, the process proceeds to an end determination step S20.

In the end determination step S20, it is determined whether or not the short-circuit detection has ended for all the first ejection elements. In a case where it is determined in the end determination step S20 that the short-circuit detection has ended for all the ejection elements that are short-circuit detection targets, the short-circuit detection method ends.

On the other hand, in a case where it is determined in the end determination step S20 that the short-circuit detection has not ended for all the first ejection elements, the process proceeds to the first ejection element setting step S10. Hereinafter, the steps from the first ejection element setting step S10 to the end determination step S20 are repeatedly executed until the short-circuit detection ends for all the first ejection elements.

After the detection result storage step S18, a non-use processing step in which a non-use process is performed on the first ejection element and the second ejection element stored as ejection elements in which the short circuit occurs in the detection result storage step S18 may be added.

The non-use process is a process in which the ejection element that is a processing target is regarded as an ejection element that does not eject ink. An example of the non-use process may include a process of inputting a maximum gradation value or a minimum gradation value as a fixed value to a pixel formed using the ejection element that is a processing target.

In a case where a plurality of second ejection elements can be set for one of the first ejection elements, the plurality of second ejection elements may be set in the second ejection element setting step S12. In the case where the plurality of second ejection elements can be set for one of the first ejection elements, the steps from the second ejection element setting step S12 to the end determination step S20 may be executed for each of the plurality of second ejection elements.

In a case where there are a plurality of first ejection elements, procedures of the short-circuit detection method illustrated in FIG. 15 may be performed in parallel in the same period for some or all of the plurality of first ejection elements.

For example, the short-circuit detection can be performed in the same period for the ejection element 68-1, the ejection element 68-5, the ejection element 68-9, and the ejection element 68-13. In a case where the ejection element 68-1 is set as the first ejection element, the ejection element 68-2 and the ejection element 68-3 are set as the second ejection elements.

Further, in a case where the ejection element 68-5 is set as the first ejection element, the ejection element 68-3, the ejection element 68-4, and the ejection element 68-6 are set as the second ejection elements. In both of a case where the ejection element 68-1 is set as the first ejection element and a case where the ejection element 68-5 is set as the first ejection element, the ejection element 68-3 is set as the second ejection element, but if the ink is also ejected from the ejection element 68-1 in a case where the ink is ejected from the ejection element 68-3, it is possible to determine that a short circuit between the ejection element 68-1 and the ejection element 68-3 occurs.

Similarly, if the ink is ejected from the ejection element 68-5 in a case where the ink is ejected from the ejection element 68-3, it is possible to determine that a short circuit between the ejection element 68-3 and the ejection element 68-5 occurs.

That is, it is possible to execute short-circuit detections in parallel in the same period for a plurality of ejection elements arranged at positions not adjacent to each other. An aspect in which short-circuit detections are executed in parallel in the same period for a plurality of ejection elements arranged at the positions not adjacent to each other between which two or more ejection elements are arranged, like the ejection element 68-1 and the ejection element 68-7, is preferable.

The short-circuit detection driving voltage supply step S14 illustrated in FIG. 15 includes a driving voltage generation step and a driving voltage supply step as components. The ejection state observation step S16 is an aspect of a detection step.

An aspect in which an abnormal element storage unit in which identification information of an abnormal ejection element that has been detected in advance is stored is included, the first driving voltage is not applied to the abnormal ejection element in the head driving unit 44 illustrated in FIG. 2 and the short-circuit detection driving voltage supply step S14 illustrated in FIG. 15, and the abnormal ejection element is excluded from short-circuit detection targets is preferable. The abnormal ejection element is an ejection element in which at least one of non-ejection in which ejection is not performed and an ejection element in which an ejection state is unstable occurs.

[Description of Operation and Effects of First Embodiment]

According to the inkjet recording device and the short-circuit detection method configured as described above, it is possible to achieve the following operation and effects.

<First Effect>

In a case where the first ejection element that is the short-circuit detection target and the second ejection element suspected of a short circuit with the first ejection element are short-circuited, ink is ejected from the first ejection element and the second ejection element, and in a case where the first ejection element and the second ejection element are not short-circuited, ink is not ejected from the first ejection element and the second ejection element.

Thus, it is possible to detect a short circuit between the first ejection element and the second ejection element according to whether or not there is ejection of the first ejection element and the second ejection element.

<Second Effect>

For the second ejection element suspected of a short circuit with the first ejection element, an ejection element arranged at a position adjacent to a position of the first ejection element can be applied. Therefore, it is possible to detect a short circuit between two ejection elements arranged at adjacent positions at which it is easy for a short circuit to occur.

<Third Effect>

The electrical wirings respectively electrically connected to two adjacent ejection elements are often arranged at positions adjacent to each other. It is possible to detect a short circuit between two adjacent ejection elements caused by a short circuit of the electrical wirings that are arranged at adjacent positions at which it is easy for the short circuit to occur.

The electrical wiring that is electrically connected to the first ejection element is an aspect of a first electrical wiring of the two adjacent ejection elements. Further, the electrical wiring that is electrically connected to the second ejection element of the two adjacent ejection elements is an aspect of a second electrical wiring.

<Fourth Effect>

The driving voltage output terminals respectively electrically connected to two adjacent ejection elements are often arranged at positions adjacent to each other. It is possible to detect a short circuit between two adjacent ejection elements caused by a short circuit of the driving voltage output terminals that are arranged at adjacent positions at which it is easy for the short circuit to occur.

Among the driving voltage output terminals respectively electrically connected to the two adjacent ejection elements, the driving voltage output terminal from which the first driving voltage to be supplied to the first ejection element is output is an aspect of a first driving voltage output terminal. Further, among the driving voltage output terminals respectively electrically connected to the two adjacent ejection elements, the driving voltage output terminal from which the second driving voltage to be supplied to the second ejection element is output is an aspect of a second driving voltage output terminal.

<Fifth Effect>

In a case where there are a plurality of second ejection elements suspected of a short circuit with the first ejection element, it is possible to detect the short circuit between the first ejection element and each of the plurality of second ejection elements.

<Sixth Effect>

The second driving voltage having the driving waveform 120B including the second waveform element 124 is applied after the resonance cycle $T_c$ of the ejection element has elapsed from the start of the first waveform element 122. Accordingly, since the ink is pressurized at a timing at which it is easy for the ink to be ejected, it is easy for the ink to be ejected from the first ejection element and the second ejection element.

[Description of Short-Circuit Detection According to Second Embodiment]

Next, short-circuit detection according to the second embodiment will be described.

<Structure Example of Inkjet Head>

In the short-circuit detection according to the second embodiment, an inkjet head having the same structure as in the first embodiment can be applied. Here, description of the structure example of the inkjet head is omitted.

<Description of Short Circuit>

In the short-circuit detection according to the second embodiment, it is possible to detect the short circuit described in the first embodiment. Here, description of the short circuit is omitted.

<Description of Short-Circuit Detection Driving Voltage According to Second Embodiment>

Figure 16:
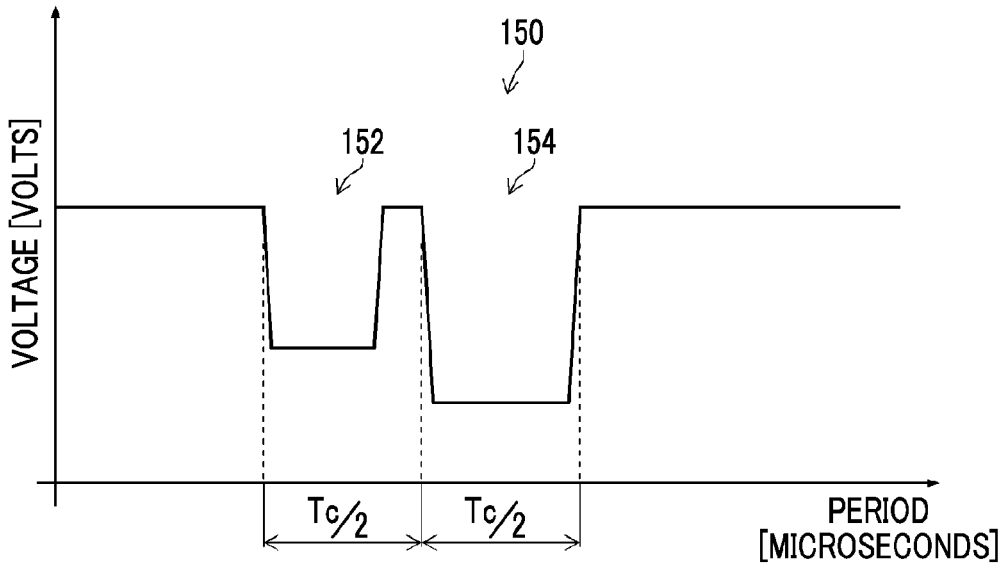
FIG. 16 is an illustrative diagram of a short-circuit detection driving voltage according to a second embodiment.

FIG. 16 is an illustrative diagram of a short-circuit detection driving voltage according to the second embodiment. In the description of the second embodiment, a configuration different from that in the first embodiment will be described. Description of the same configuration as in the first embodiment will be appropriately omitted.

A driving waveform 150 illustrated in FIG. 16 includes a third waveform element 152 and a fourth waveform element 154. A period from start of the third waveform element 152 to start of the fourth waveform element 154 is ½ of a resonance cycle $T_c$ of the ejection element. Further, a pulse width of the fourth waveform element 154 is ½ of the resonance cycle $T_c$ of the ejection element.

Here, for a pulse width of the fourth waveform element 154, a period from the start of the fourth waveform element 154 to the end of the fourth waveform element 154 can be applied.

Figure 17:
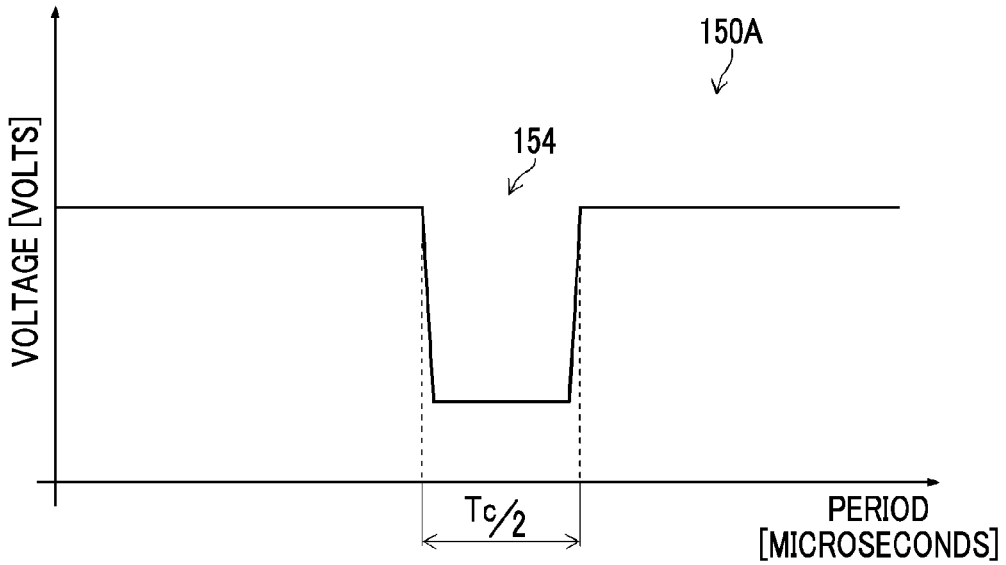
FIG. 17 is an illustrative diagram of a fourth waveform element.

FIG. 17 is an illustrative diagram of a fourth driving voltage. A first driving voltage having a driving waveform 150A including the fourth waveform element 154 illustrated in FIG. 17 is a driving voltage for causing liquid to be ejected from each ejection element if the first driving voltage is applied to each ejection element alone.

Although not illustrated, a second driving voltage having a driving waveform including the third waveform element 152 illustrated in FIG. 16 is a driving voltage that cannot cause liquid to be ejected from each ejection element even when the second driving voltage is applied to each ejection element alone.

The driving voltage having the driving waveform 150 illustrated in FIG. 16 is prepared. The driving voltage having the driving waveform 150A including the fourth waveform element 154 illustrated in FIG. 17 is supplied to the first ejection element.

Further, the driving voltage having the driving waveform including the third waveform element 152 illustrated in FIG. 16 is supplied to the second ejection element.

In a case where the short circuit between the first ejection element and the second ejection element does not occur, ink is ejected from the first ejection element. Ink is not ejected from the second ejection element. On the other hand, in a case where the short circuit between the first ejection element and the second ejection element occurs, ink is not ejected from both of the first ejection element and the second ejection element.

Whether or not there is ejection of the first ejection element and the second ejection element in the case where a short circuit between the first ejection element and the second ejection element does not occur and whether or not there is ejection of the first ejection element and the second ejection element in the case where the short circuit between the first ejection element and the second ejection element occurs are shown in [Table 2].

TABLE 2

| | First driving waveform | Second driving waveform | Ejection |
|---|---|---|---|
| Arbitrary normal ejection element | Application | Non-application | Performed |
| Another normal ejection element | Non-application | Application | Not performed |
| First ejection element (there is short circuit) | Application | Application | Not performed |
| Second ejection element (there is short circuit) | Application | Application | Not performed |

The arbitrary normal ejection element in [Table 2] is a first ejection element in a case where the short circuit between the first ejection element and the second ejection element does not occur. Further, another normal ejection element in [Table 2] is a second ejection element in which the short circuit between the first ejection element and the second ejection element does not occur.

In a case where there is a probability of there being two or more sets of ejection elements of which a short circuit is likely to occur, a combination of the first ejection element and the second ejection element may be changed and supply of the first driving voltage and the second driving voltage may be performed repeatedly.

If the second driving voltage having the driving waveform including the third waveform element 152 is applied before the first driving voltage having the driving waveform including the fourth waveform element 154 is applied at a timing illustrated in FIG. 16, ink meniscus within the ejection element is moved a period of ½ of the resonance cycle $T_c$ of the ejection element ago from the start of the first driving voltage.

A motion of the ink meniscus within the ejection element that is generated due to the application of the second driving voltage occurs. An ink meniscus motion within the ejection element generated due to the application of the first driving voltage and an ink meniscus motion within the ejection element generated due to the application of the second driving voltage are canceled from each other.

Therefore, if both of the first driving voltage and the second driving voltage are applied to the first ejection element, it is not possible to cause liquid to be ejected from the first ejection element. The start of the first driving voltage described herein is the start of the fourth waveform element 154 illustrated in FIG. 16.

A period from the start of the third waveform element 152 to the start of the fourth waveform element 154 can be a period having a lower limit value calculated by multiplying ½ of the resonance cycle $T_c$ of the ejection element by a constant $\beta_1$ and an upper limit value calculated by multiplying ½ of the resonance cycle $T_c$ of the ejection element by a constant $\beta_2$.

The constant $\beta_1$ and the constant $\beta_2$ are determined from a condition in which the ink cannot be caused to be ejected from the first ejection element in a case where the short circuit between the first ejection element and the second ejection element occurs. Further, there is a relationship of constant $\beta_1$<constant $\beta_2$.

<Observation of Ejection State of Ink>

Figure 18:
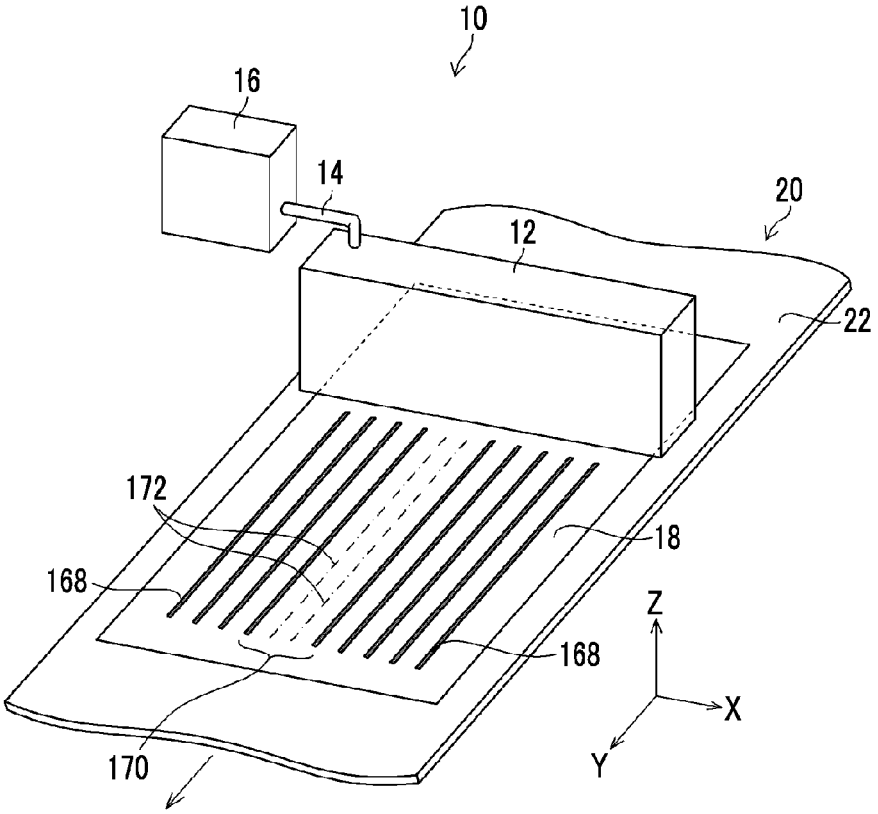
FIG. 18 is an illustrative diagram schematically illustrating observation of dots formed on a medium according to the second embodiment.

FIG. 18 is an illustrative diagram schematically illustrating observation of dots formed on a medium according to the second embodiment. In the example illustrated in FIG. 18, the sheet 18 is conveyed in the sheet conveyance direction, the first driving voltage is supplied to the first ejection element, and the second driving voltage is supplied to the second ejection element.

In a case where the short circuit between the first ejection element and the second ejection element occurs, a missing area 170 in which dot arrays 168 are not formed, which is illustrated in FIG. 18, is generated. Single dotted lines denoted with a reference sign 172, which are illustrated in FIG. 18, are dot arrays that are originally formed in the missing area 170.

On the other hand, in a case where the short circuit between the first ejection element and the second ejection element does not occur, the missing area 170 in which the dot arrays 168 are not formed, which is illustrated in FIG. 18, is not generated.

That is, by observing whether or not the missing area 170 of the dot array 168 in the sheet 18 is formed, it is possible to determine whether or not the short circuit between the first ejection element and the second ejection element occurs.

For the observation of whether or not there is the missing area 170 of the dot array 168 in the sheet 18, visual inspection of an operator can be applied. In a case where whether or not there is the missing area 170 of the dot array 168 in the sheet 18 is observed using the visual inspection of the operator, observation information input by the operator is acquired using the detection information acquisition unit 49 illustrated in FIG. 2. The detection information acquisition unit 49 is an aspect of an observation result information acquisition unit.

For the observation of whether or not there is the missing area 170 of the dot array 168 in the sheet 18, imaging using an imaging device can be applied. In a case where whether or not there is the missing area 170 of the dot array 168 in the sheet 18 is observed using the imaging device, imaging data obtained using the imaging device is acquired using the detection information acquisition unit 49 illustrated in FIG. 2. For the imaging device, the same imaging device as the imaging device 130 illustrated in FIG. 12 can be applied.

<Procedure of Short-Circuit Detection Method>

Figure 19:
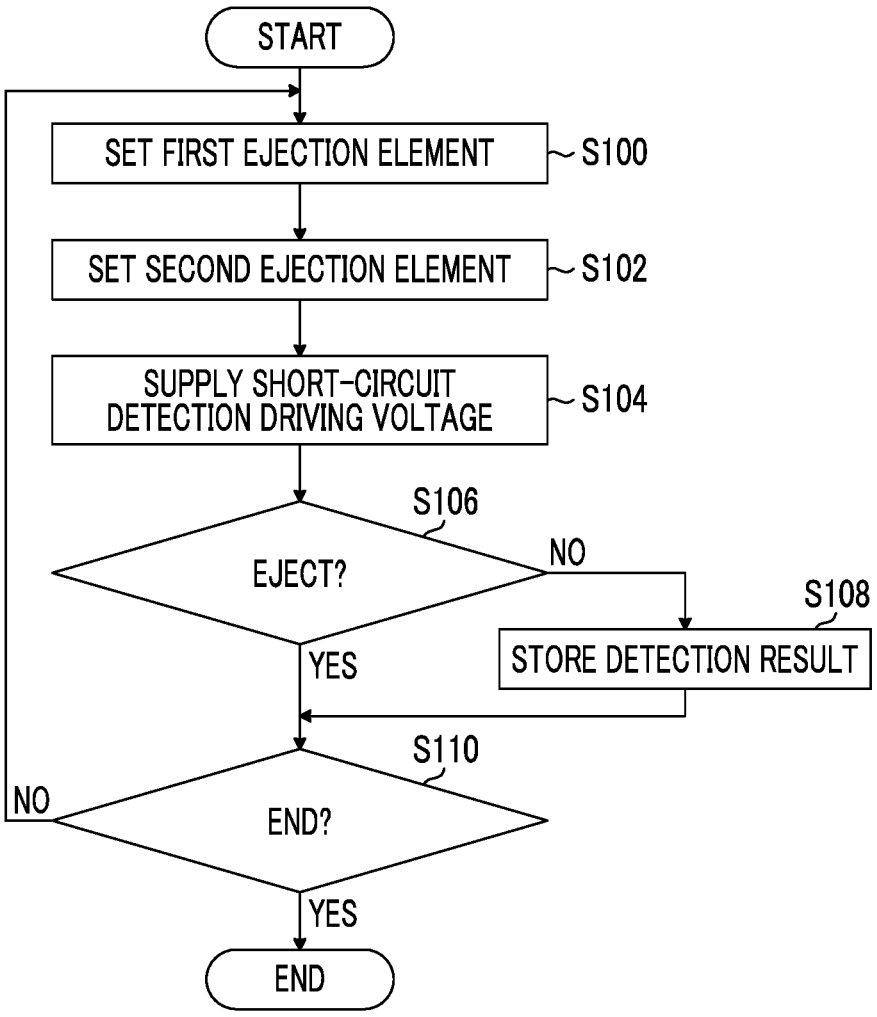
FIG. 19 is a flowchart illustrating a flow of a procedure of a short-circuit detection method according to the second embodiment.

FIG. 19 is a flowchart illustrating a flow of a procedure of the short-circuit detection method according to the second embodiment. In a first ejection element setting step S100 and a second ejection element setting step S102 illustrated in FIG. 19, since the same process as in the first ejection element setting step S10 and the second ejection element setting step S12 illustrated in FIG. 15 is executed, description thereof is omitted herein.

In a short-circuit detection driving voltage supply step S104 illustrated in FIG. 19, the first driving voltage having the driving waveform 150A including the fourth waveform element 154 illustrated in FIG. 17 is generated. Further, in the short-circuit detection driving voltage supply step S104 illustrated in FIG. 19, the second driving voltage having the driving waveform including a third waveform element 152 illustrated in FIG. 16 is generated.

In the short-circuit detection driving voltage supply step S104 illustrated in FIG. 19, the first driving voltage having the driving waveform 150A including the fourth waveform element 154 illustrated in FIG. 17 is supplied to the first ejection element, and, the second driving voltage having the driving waveform including the third waveform element 152 illustrated in FIG. 16 is supplied to the second ejection element. Then, the process proceeds to an ejection state observation step S106 illustrated in FIG. 19.

In an ejection state observation step S106, an ejection state of the ink is observed. In the ejection state observation step S106, in a case where an observation result indicating that ink is not ejected from the first ejection element is acquired, a result of the observation is a No determination. In the case of the No determination, the process proceeds to a detection result storage step S108.

In the detection result storage step S108, identification information of the first ejection element and the second ejection element is stored. In the detection result storage step S108, after the identification information of the first ejection element and the second ejection element is stored, the process proceeds to an end determination step S110.

On the other hand, in the ejection state observation step S106, in a case where an observation result indicating that ink is ejected from the first ejection element is acquired, a result of the observation is a Yes determination. In the case of the Yes determination, the process proceeds to an end determination step S110.

In the end determination step S110, it is determined whether or not the short-circuit detection has ended for all the first ejection elements. In a case where it is determined in the end determination step S110 that the short-circuit detection has ended for all the first ejection elements, a result of the determination is a Yes determination. In the case of the Yes determination, the short-circuit detection method ends.

On the other hand, in a case where it is determined in the end determination step S110 that the short-circuit detection has not ended for all the first ejection elements, a result of the determination is a No determination. In the case of the No determination, the process proceeds to the first ejection element setting step S100. Hereinafter, the steps from the first ejection element setting step S100 to the end determination step S110 are repeatedly executed until the short-circuit detection ends for all the first ejection elements.

The short-circuit detection driving voltage supply step S104 illustrated in FIG. 19 includes a driving voltage generation step and a driving voltage supply step as components. The ejection state observation step S106 is an aspect of the detection step.

[Description of Operation and Effects of Second Embodiment]

According to the short-circuit detection method according to the second embodiment, it is possible to obtain the same effects as in the first embodiment.

Although the inkjet recording device 10 including only one inkjet head 12 is illustrated in the first embodiment and the second embodiment, at least one inkjet head 12 for each color to be used for image formation may be included.

An example in which inkjet heads corresponding to a plurality of respective colors are included may include an aspect in which an inkjet head that ejects cyan ink, an inkjet head that ejects magenta ink, an inkjet head that ejects yellow ink, and an inkjet head that ejects black ink are included.

The image includes an image for use other than graphical use, such as a pattern of an electrical wiring or a pattern of a mask. For example, the pattern formation device in which an electrical wiring pattern is formed or a mask pattern formation device in which a mask pattern is formed is an aspect of a liquid ejection device.

As the ink, ink that can be ejected in a droplet state by applying the inkjet head, such as ink containing metal particles or ink containing resin particles, can be applied.

In the embodiment of the present invention described above, configuration requirements can be appropriately changed, added, or removed without departing from the scope of the present invention. The present invention is not limited to the above-described embodiments, and many modifications can be performed by those with ordinary skill in the art within the technical spirit of the present invention.

EXPLANATION OF REFERENCES

10: inkjet recording device
12: inkjet head
14: tube
16: ink tank
18: sheet
20: sheet conveyance unit
22: conveyance belt
24: dot
30: system control unit
32: communication unit
33: host computer
34: image memory
36: conveyance control unit
38: image processing unit
40: waveform generation unit
42: waveform storage unit
44: head driving unit
46: parameter storage unit
48: program storage unit
49: detection information acquisition unit
50: head controller
52: digital-to-analog conversion circuit
54: amplification circuit
56: shift register
58: latch circuit
60: level conversion circuit
62: switch element
64: switch element integrated circuit
65-1, 65-2, 65-3, 65-4, 65-5, 65-6, 65-7, 65-8, 65-9, 65-10, 65-11, 65-12, 65-13, 65-14, 65-15, 65-16: driving voltage output terminal
68, 68-1, 68-2, 68-3, 68-4, 68-5, 68-6, 68-7, 68-8, 68-9, 68-10, 68-11, 68-12, 68-13, 68-14, 68-15, 68-16: ejection element
80: nozzle opening
82: nozzle plate
84: pressure chamber
86: vibration plate
88, 88-1, 88-2, 88-3, 88-4, 88-5, 88-6, 88-7, 88-8, 88-9, 88-10, 88-11, 88-12, 88-13, 88-14, 88-15, 88-16: piezoelectric element
90: supply port
92: common flow path
94: upper electrode
96: lower electrode
98: piezoelectric body
99: flow path plate
100: flexible substrate
102, 102A, 102B, 102C, 104: electrical wiring
110, 112: conductive material
120, 120A, 120B, 150, 150A: driving waveform
122: first waveform element
124: second waveform element
130: imaging device
132: light source
134: droplet-like ink
136: liquid passage area

138, 140, 168, 172: dot array
152: third waveform element
154: fourth waveform element
170: missing area
$P_{NX1}$, $P_{NX2}$, $P_{NY}$: arrangement interval
S10 to S20, S100 to S110: each step of short-circuit detection method

What is claimed is:

1. A liquid ejection device, comprising:

a liquid ejection head including a plurality of ejection elements;

a driving voltage generation unit that generates a first driving voltage that is used at the time of detection of a short circuit of the plurality of ejection elements and a second driving voltage that is used at the time of detection of a short circuit of the plurality of ejection elements; and a driving voltage supply unit that supplies the first driving voltage to the first ejection element that is a detection target of a short circuit between ejection elements, and supplies the second driving voltage to the second ejection element that is suspected of the short circuit with the first ejection element, wherein the driving voltage generation unit generates the first driving voltage and the second driving voltage in which whether or not there is ejection of liquid from the first ejection element in a case where the first driving voltage alone is applied to the first ejection element is different from whether or not there is ejection of liquid from the first ejection element in a case where the first driving voltage and the second driving voltage are applied to the first ejection element.

2. The liquid ejection device according to claim 1, wherein a first electrical wiring electrically connected to the first ejection element and a second electrical wiring electrically connected to the second ejection element are arranged at adjacent positions.

3. The liquid ejection device according to claim 1, wherein a first driving voltage output terminal from which a first driving voltage to be supplied to the first ejection element is output and a second driving voltage output terminal from which a second driving voltage to be supplied to the second ejection element is output are arranged at adjacent positions.

4. The liquid ejection device according to claim 1, wherein the driving voltage supply unit regards all ejection elements that are likely to be short-circuited to the first ejection element as the second ejection elements, and supplies the second driving voltage.

5. The liquid ejection device according to claim 1, further comprising an imaging data acquisition unit that acquires imaging data obtained using an imaging device that images a liquid passage area through which liquid ejected from the plurality of ejection elements passes in a period in which the first driving voltage is supplied from the driving voltage supply unit to the first ejection element, and the second driving voltage is supplied from the driving voltage supply unit to the second ejection element.

6. The liquid ejection device according to claim 1, further comprising an observation result information acquisition unit that acquires an observation result of observation of whether or not there is a dot in a medium after a period in which the first driving voltage is supplied from the driving voltage supply unit to the first ejection element and after a period in which the second driving voltage is supplied from the driving voltage supply unit to the second ejection element.

7. The liquid ejection device according to claim 1, wherein the driving voltage generation unit generates the first driving voltage that does not cause the liquid to be ejected from the first ejection element in a case where the first driving voltage alone is applied to the first ejection element, and the second driving voltage that does not cause the liquid to be ejected from the second ejection element in a case where the second driving voltage alone is applied to the second ejection element, and the first driving voltage and the second driving voltage are driving voltages that cause the liquid to be ejected from the first ejection element and the second ejection element in a case where the first driving voltage and the second driving voltage are applied to the first ejection element and the second ejection element.

8. The liquid ejection device according to claim 7, wherein the driving voltage supply unit supplies the first driving voltage to the first ejection element, and then, supplies, to the second ejection element, the second driving voltage in which a period from the start of the first driving voltage to the start of the second driving voltage is within a predetermined range including a resonance cycle of the ejection element.

9. The liquid ejection device according to claim 1, wherein the driving voltage generation unit generates the first driving voltage that does not cause the liquid to be ejected from the first ejection element in a case where the first driving voltage alone is applied to the first ejection element, and the second driving voltage that does not cause the liquid to be ejected from the second ejection element in a case where the second driving voltage alone is applied to the second ejection element, and the first driving voltage and the second driving voltage are driving voltages that cause the liquid to be ejected from the first ejection element in a case where the first driving voltage and the second driving voltage are applied to the first ejection element, and are driving voltages that do not cause the liquid to be ejected from the second ejection element in a case where the first driving voltage and the second driving voltage are applied to the second ejection element.

10. The liquid ejection device according to claim 9, wherein the driving voltage supply unit supplies the second driving voltage to the second ejection element, and then, supplies, to the first ejection element, the first driving voltage in which a period from the start of the second driving voltage to the start of the first driving voltage is within a predetermined range including a resonance cycle of the ejection element.

11. A short-circuit detection method of detecting a short circuit between ejection elements in a liquid ejection head including a plurality of ejection elements, the method comprising:

a driving voltage generation step of generating a first driving voltage that is used at the time of detection of a short circuit of the plurality of ejection elements and a second driving voltage that is used at the time of detection of a short circuit of the plurality of ejection elements;

a driving voltage supply step of supplying the first driving voltage to the first ejection element that is a detection target of a short circuit between ejection elements, and supplies the second driving voltage to the second ejection element that is suspected of the short circuit with the first ejection element; and a detection step of detecting whether or not there is a short circuit between the first ejection element and the second ejection element on the basis of whether or not there is ejection of the first ejection element, wherein the driving voltage generation step includes generating the first driving voltage and the second driving voltage in which whether or not there is ejection of liquid from the first ejection element in a case where the first driving voltage alone is applied to the first ejection element is different from whether or not there is ejection of liquid from the first ejection element in a case where the first driving voltage and the second driving voltage are applied to the first ejection element.

* * * * *